US010227826B2

(12) United States Patent
Odell, II et al.

(10) Patent No.: US 10,227,826 B2
(45) **Date of Patent: *Mar. 12, 2019**

(54) METHOD AND APPARATUS FOR OPERATING A DOWNHOLE TOOL

(71) Applicant: Weatherford Technology Holdings, LLC, Houston, TX (US)

(72) Inventors: Albert C. Odell, II, Kingwood, TX (US); Marius Raducanu, College Station, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 731 days.

This patent is subject to a terminal disclaimer.

(21) Appl. No.: 14/276,956

(22) Filed: May 13, 2014

(65) Prior Publication Data

US 2014/0332270 A1 Nov. 13, 2014

Related U.S. Application Data

(60) Provisional application No. 61/822,814, filed on May 13, 2013.

(51) Int. Cl.

| | |
|---|---|
| ***E21B 7/00*** | (2006.01) |
| ***E21B 7/28*** | (2006.01) |
| ***E21B 10/26*** | (2006.01) |
| ***E21B 10/32*** | (2006.01) |
| ***E21B 41/00*** | (2006.01) |

(Continued)

(52) U.S. Cl.

CPC ..... *E21B 10/322* (2013.01); *E21B 7/00* (2013.01); *E21B 7/128* (2013.01); *E21B 10/26* (2013.01); *E21B 41/00* (2013.01); *E21B 47/12* (2013.01); *E21B 47/122* (2013.01)

(58) Field of Classification Search

CPC ..... E21B 10/32; E21B 10/322; E21B 47/122; E21B 47/12; E21B 7/28; E21B 10/26; E21B 10/30; E21B 7/00; E21B 41/00

See application file for complete search history.

(56) References Cited

U.S. PATENT DOCUMENTS

| | | | |
|---|---|---|---|
| 3,800,277 | A | 3/1974 | Patton et al. |
| 5,332,048 | A | 7/1994 | Underwood et al. |

(Continued)

FOREIGN PATENT DOCUMENTS

| | | | |
|---|---|---|---|
| WO | 93/15306 | A1 | 8/1993 |
| WO | 2010/054407 | A1 | 5/2010 |
| WO | 2012/082248 | A1 | 6/2012 |

OTHER PUBLICATIONS

PCT Search Report and Written Opinion for International Application No. PCT/US2014/037925 dated Mar. 18, 2015.

(Continued)

*Primary Examiner* — Nicole Coy

(74) *Attorney, Agent, or Firm* — Patterson + Sheridan, LLP

(57) ABSTRACT

In another embodiment, a method of drilling a wellbore includes running a drilling assembly into the wellbore through a casing string, the drilling assembly comprising a tubular string, an underreamer, and a drill bit; injecting drilling fluid through the tubular string and rotating the drill bit, wherein the underreamer remains locked in the retracted position; sending an instruction signal to the underreamer via modulation of a rotational speed of the drilling assembly or modulation of a drilling fluid pressure, thereby extending the underreamers; and reaming the wellbore using the extended underreamer.

19 Claims, 17 Drawing Sheets

(51) Int. Cl.
*E21B 47/12* (2012.01)
*E21B 7/128* (2006.01)

(56) References Cited

U.S. PATENT DOCUMENTS

| | | | |
|---|---|---|---|
| 6,289,999 | B1 | 9/2001 | Dewey et al. |
| 7,048,078 | B2 | 5/2006 | Dewey et al. |
| 7,252,152 | B2 | 8/2007 | LoGiudice et al. |
| 7,891,441 | B2 | 2/2011 | Lee |
| 7,900,717 | B2 | 3/2011 | Radford et al. |
| 8,028,767 | B2 | 10/2011 | Radford et al. |
| 2003/0155155 | A1 | 8/2003 | Dewey et al. |
| 2005/0145417 | A1 | 7/2005 | Radford et al. |
| 2006/0207797 | A1 | 9/2006 | Dewey et al. |
| 2008/0128169 | A1 | 6/2008 | Radford et al. |
| 2010/0089583 | A1 | 4/2010 | Xu et al. |
| 2012/0067594 | A1 | 3/2012 | Noske et al. |

OTHER PUBLICATIONS

Presentation paper from the 1994 IADC/SPE Drilling Conference held in Dallas, Texas on Feb. 15-18, 1994 by L. D. Underwood and A.C. Odell II, "A Systems Approach to Downhole Adjustable Stabilizer Design and Application" Halliburton Drilling Services, dated pp. 475-488.

Canadian Office Action dated Sep. 8, 2016, for Canadian Patent Application No. 2,912,437.

EPO Office Action dated Feb. 1, 2017, for European Patent Application No. 14729815.2.

Canadian Office Action dated Jul. 4, 2017, for Canadian Patent Application No. 2,912,437.

Canadian Office Action dated May 2, 2018, for Canadian Patent Application No. 2,912,437.

METHOD AND APPARATUS FOR OPERATING A DOWNHOLE TOOL

BACKGROUND OF THE INVENTION

Field of the Invention

Embodiments of the present invention generally relate to methods and apparatus for operating a downhole tool.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. The second casing or liner string is then cemented. This process is typically repeated with additional casing or liner strings until the well has been drilled to total depth. In this manner, wells are typically formed with two or more strings of casing/liner of an ever-decreasing diameter.

As more casing/liner strings are set in the wellbore, the casing/liner strings become progressively smaller in diameter to fit within the previous casing/liner string. In a drilling operation, the drill bit for drilling to the next predetermined depth must thus become progressively smaller as the diameter of each casing/liner string decreases. Therefore, multiple drill bits of different sizes are ordinarily necessary for drilling operations. As successively smaller diameter casing/liner strings are installed, the flow area for the production of oil and gas is reduced. Therefore, to increase the annulus for the cementing operation, and to increase the production flow area, it is often desirable to enlarge the borehole below the terminal end of the previously cased/lined borehole. By enlarging the borehole, a larger annulus is provided for subsequently installing and cementing a larger casing/liner string than would have been possible otherwise. Accordingly, by enlarging the borehole below the previously cased borehole, the bottom of the formation can be reached with comparatively larger diameter casing/liner, thereby providing more flow area for the production of oil and/or gas. Underreamers also lessen the equivalent circulation density (ECD) while drilling the borehole.

In order to accomplish drilling a wellbore larger than the bore of the casing/liner, a drill string with an underreamer and pilot bit may be employed. Underreamers may include a plurality of arms which may move between a retracted position and an extended position. The underreamer may be passed through the casing/liner, behind the pilot bit when the arms are retracted. After passing through the casing, the arms may be extended in order to enlarge the wellbore below the casing.

SUMMARY OF THE INVENTION

In another embodiment, a method of drilling a wellbore includes running a drilling assembly into the wellbore through a casing string, the drilling assembly comprising a tubular string, an underreamer, and a drill bit; injecting drilling fluid through the tubular string and rotating the drill bit, wherein the underreamer remains locked in the retracted position; sending an instruction signal to the underreamer via modulation of a rotational speed of the drilling assembly or modulation of a drilling fluid flow rate, thereby extending the underreamer; and reaming the wellbore using the extended underreamer.

In one embodiment, a method of drilling a wellbore includes running a drilling assembly into the wellbore through a casing string, the drilling assembly comprising a tubular string, upper and lower underreamers, and a drill bit; injecting drilling fluid through the tubular string and rotating the drill bit, wherein at least one of the underreamers remain locked in the retracted position; sending a first instruction signal to the underreamers to extend one of the underreamers; drilling and reaming the wellbore using the drill bit and the extended underreamer; sending a second instruction signal to the underreamers via modulation of a rotational speed of the drilling assembly or modulation of a drilling fluid flow rate, thereby extending the other of the underreamers; and reaming the wellbore using the extended other underreamer.

In one or more of the embodiments described herein, the instruction signal includes a trigger portion and a command portion.

In another embodiment, a method of drilling a wellbore includes running a drilling assembly into the wellbore through a casing string, the drilling assembly comprising a tubular string, a MWD tool or LWD tool, an underreamer, and a drill bit; injecting drilling fluid through the tubular string and rotating the drill bit, wherein the underreamer remains locked in the retracted position; sending an instruction signal to the underreamer, thereby extending the underreamer; and reaming the wellbore using the extended underreamer.

In one or more of the embodiments described herein, the instruction signal is sent using a RFID tag.

In one or more of the embodiments described herein, the RFID tag flows past the MWD tool or LWD tool and is received by the underreamer.

In one or more of the embodiments described herein, modulation of the rotational speed or fluid flow rate is time based.

In one or more of the embodiments described herein, modulation of the rotational speed or fluid pressure is not time based.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 6 shows the control module in the closed position.

DETAILED DESCRIPTION

Figure 1B:
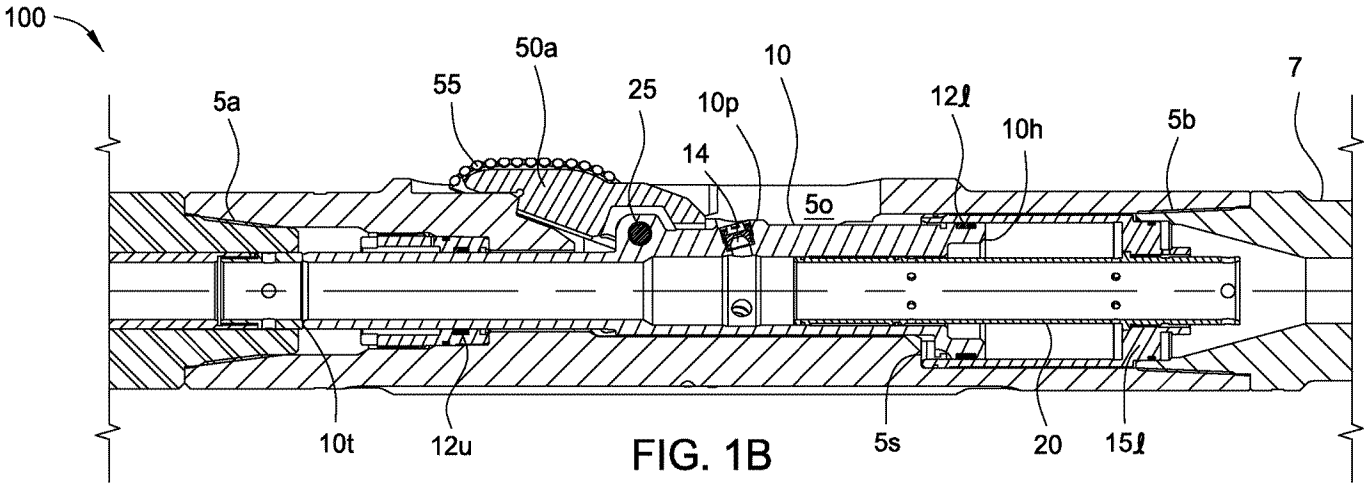
FIGS. 1A and 1B are cross-sections of an underreamer in a retracted and extended position, respectively, according to one embodiment of the present invention.
Figure 1A:
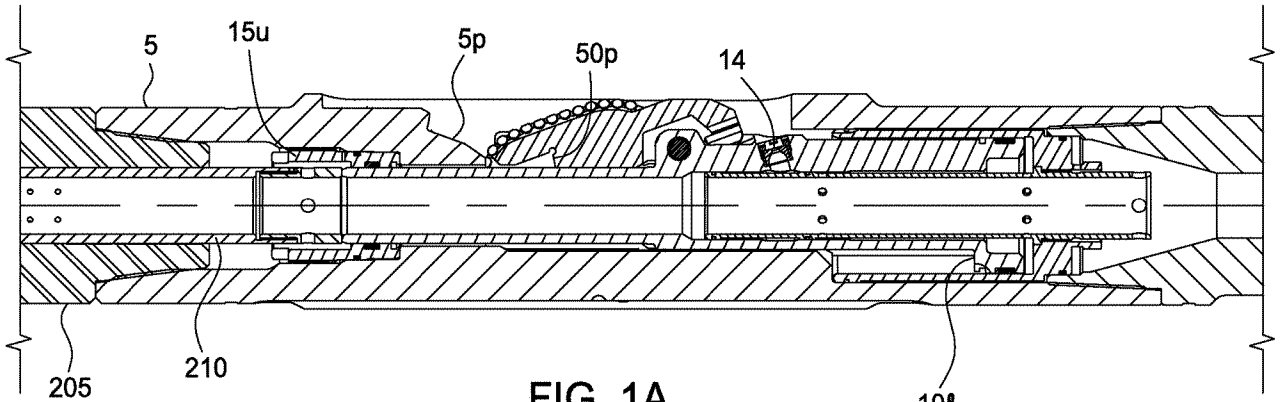

FIGS. 1A and 1B are cross-sections of an underreamer 100 in a retracted and extended position, respectively, according to one embodiment of the present invention.

Figure 1C:
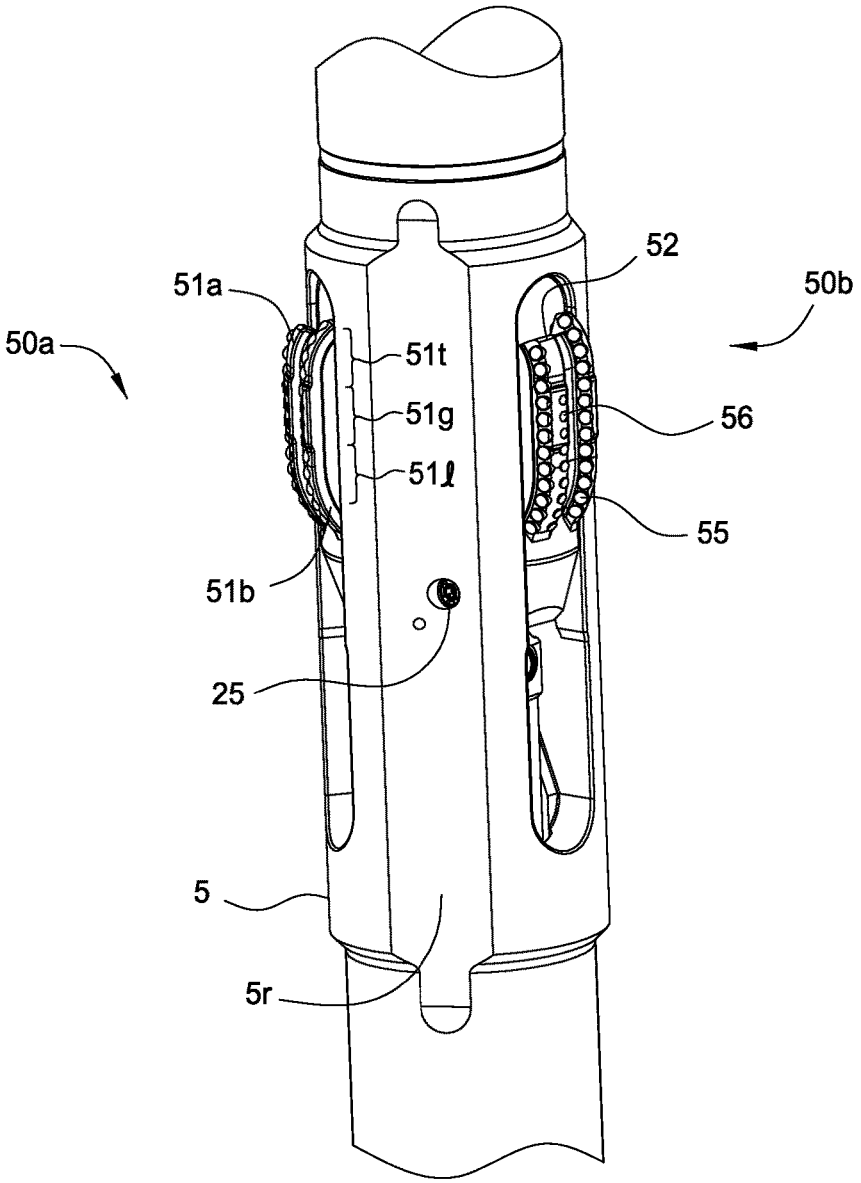
FIG. 1C is an isometric view of arms of the underreamer.

The underreamer 100 may include a body 5, an adapter 7, a piston 10, one or more seal sleeves 15*u,l*, a mandrel 20, and one or more arms 50*a,b* (see FIG. 1C for 50*b*). The body 5 may be tubular and have a longitudinal bore formed therethrough. Each longitudinal end 5*a,b* of the body 5 may be threaded for longitudinal and rotational coupling to other members, such as a control module 200 at 5*a* and the adapter 7 at 5*b*. The body 5 may have an opening 5*o* formed through a wall thereof for each arm 50*a,b*. The body 5 may also have a chamber formed therein at least partially defined by shoulder 5*s* for receiving a lower end of the piston 10 and the lower seal sleeve 15*l*. The body 5 may include an actuation profile 5*p* formed in a surface thereof for each arm 50*a,b* adjacent the opening 5*o*. An end of the adapter 7 distal from the body (not shown) may be threaded for longitudinal and rotational coupling to another member of a bottomhole assembly (BHA).

The piston 10 may be a tubular, have a longitudinal bore formed therethrough, and may be disposed in the body bore. The piston 10 may have a flow port 10*p* formed through a wall thereof corresponding to each arm 50*a,b*. A nozzle 14 may be disposed in each port 10*p* and made from an erosion resistant material, such as a metal, alloy, ceramic, or cermet. The mandrel 20 may be tubular, have a longitudinal bore formed therethrough, and be longitudinally coupled to the lower seal sleeve 15*l* by a threaded connection. The lower seal sleeve 15*l* may be longitudinally coupled to the body 5 by being disposed between the shoulder 5*s* and a top of the adapter 7. The upper seal sleeve 15*u* may be longitudinally coupled to the body 5 by a threaded connection.

Each arm 50*a,b* may be movable between an extended and a retracted position and may initially be disposed in the opening 5*o* in the retracted position. Each arm 50*a,b* may be pivoted to the piston 10 by a fastener 25. Each arm 50*a,b* may be biased radially inward by a torsion spring (not shown) disposed around the fastener 25. A surface of the body 5 defining each opening 5*o* may serve as a rotational stop for a respective blade 50*a,b*, thereby rotationally coupling the blade 50*a,b* to the body 5 (in both the extended and retracted positions). Each arm 50*a,b* may include an actuation profile 50*p* formed in an inner surface thereof corresponding to the profile 5*p*. Movement of each arm 50*a,b* along the actuation profile 5*p* may force the arm radially outward from the retracted position to the extended position. Each actuation profile 5*p*, 50*p* may include a shoulder. The shoulders may be inclined relative to a radial axis of the body 5 in order to secure each arm 50*a,b* to the body in the extended position so that the arms do not chatter or vibrate during reaming. The inclination of the shoulders may create a radial component of the normal reaction force between each arm and the body 5, thereby holding each arm 50*a,b* radially inward in the extended position. Additionally, the actuation profiles 5*p*, 50*p* may each be circumferentially inclined (not shown) to retain the arms 50*a,b* against a trailing surface of the body defining the opening 5*o* to further ensure against chatter or vibration.

The underreamer 100 may be fluid operated by drilling fluid injected through the drill string being at a high pressure and drilling fluid and cuttings, collectively returns, flowing to the surface via the annulus being at a lower pressure. A first surface 10*h* of the piston 10 may be isolated from a second surface 10*l* of the piston 10 by a lower seal 12*l* disposed between an outer surface of the piston 10 and an inner surface of the lower seal sleeve 15*l*. The lower seal 12*l* may be a ring or stack of seals, such as chevron seals, and made from a polymer, such as an elastomer. The high pressure may act on the first surface 10*h* of the piston via one or more ports formed through a wall of the mandrel 20 and the low pressure may act on the second surface 10*l* of the piston 10 via fluid communication with the openings 5*o*, thereby creating a net actuation force and moving the arms 50*a,b* from the retracted position to the extended position. An upper seal 12*u* may be disposed between the upper seal sleeve 15*u* and an outer surface of the piston 10 to isolate the openings 5*o*. The upper seal 12*u* may be a ring or stack of seals, such as chevron seals, and made from a polymer, such as an elastomer. Various other seals, such as o-rings may be disposed throughout the underreamer 100.

In the retracted position, the piston ports 10*p* may be closed by the mandrel 20 and straddled by seals, such as o-rings, to isolate the ports from the piston bore. In the extended position, the flow ports 10*p* may be exposed to the piston bore, thereby discharging a portion of the drilling fluid into the annulus to cool and lubricate the arms 50*a,b* and carry cuttings to the surface. This exposure of the flow ports 10*p* may result in a drop in upstream pressure, thereby providing an indication at the surface that the arms 50*a,b* are extended.

FIG. 1C is an isometric view of the arms 50*a,b*. An outer surface of each arm 50*a,b* may form one or more blades 51*a,b* and a stabilizer pad 52 between each of the blades. Cutters 55 may be bonded into respective recesses formed along each blade 51*a,b*. The cutters 55 may be made from a super-hard material, such as polycrystalline diamond compact (PDC), natural diamond, or cubic boron nitride. The PDC may be conventional, cellular, or thermally stable (TSP). The cutters 55 may be bonded into the recesses, such as by brazing, welding, soldering, or using an adhesive. Alternatively, the cutters 55 may be pressed or threaded into the recesses. Inserts, such as buttons 56, may be disposed along each pad 52. The inserts 56 may be made from a wear-resistant material, such as a ceramic or cermet (e.g., tungsten carbide). The inserts 56 may be brazed, welded, or pressed into recesses formed in the pad 52.

The arms 50*a,b* may be longitudinally aligned and circumferentially spaced around the body 5 and junk slots 5*r* may be formed in an outer surface of the body between the arms. The junk slots 5*r* may extend the length of the openings 5*o* to maximize cooling and cuttings removal (both from the drill bit and the underreamer). The arms 50*a,b* may be concentrically arranged about the body 5 to reduce vibration during reaming. The underreamer 100 may include a third arm (not shown) and each arm may be spaced at one-hundred twenty degree intervals. The arms 50*a,b* may be made from a high strength metal or alloy, such as steel. The blades 51*a,b* may each be arcuate, such as parabolic, semi-elliptical, semi-oval, or semi-super-elliptical. The arcuate blade shape may include a straight or substantially straight gage portion 51*g* and curved leading 51*l* and trailing 51*t* ends, thereby allowing for more cutters 55 to be disposed at the gage portion thereof and providing a curved actuation surface against a previously installed casing shoe when retrieving the underreamer 100 from the wellbore should the actuator spring be unable to retract the blades. Cutters 55 may be disposed on both a leading and trailing surface of each blade for back-reaming capability. The cutters in the leading and trailing ends of each blade may be super-flush with the blade. The gage portion may be raised and the gage-cutters flattened and flush with the blade, thereby ensuring a concentric and full-gage hole.

Alternatively, the cutters 55 may be omitted and the underreamer 100 may be used as a stabilizer instead.

Figure 2B:
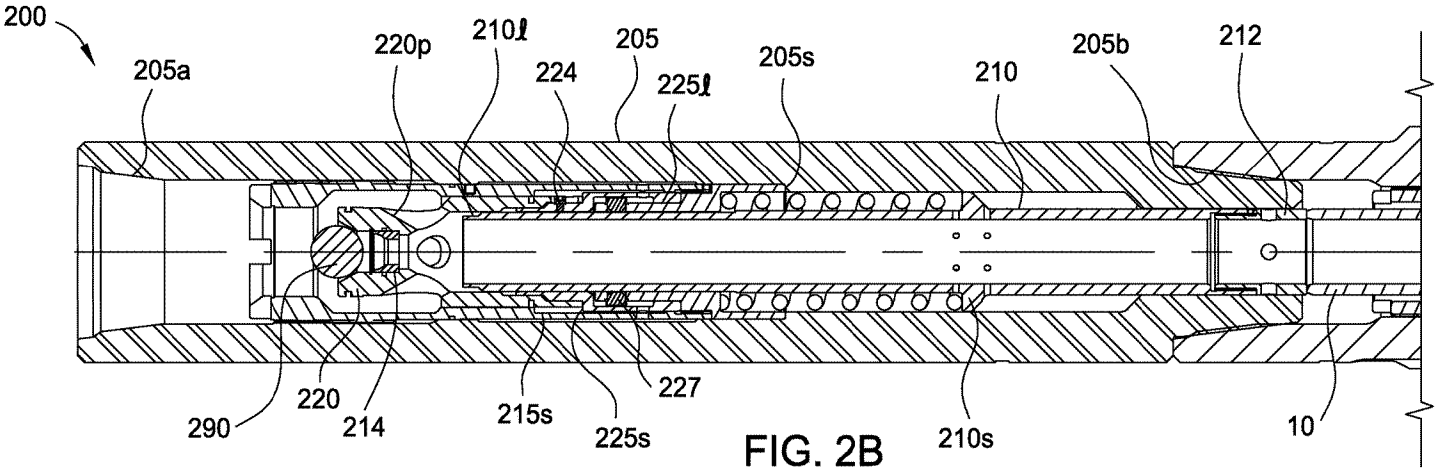
FIGS. 2A and 2B are cross-sections of a mechanical control module connected to the underreamer in a retracted and extended position, respectively, according to another embodiment of the present invention.
Figure 2A:
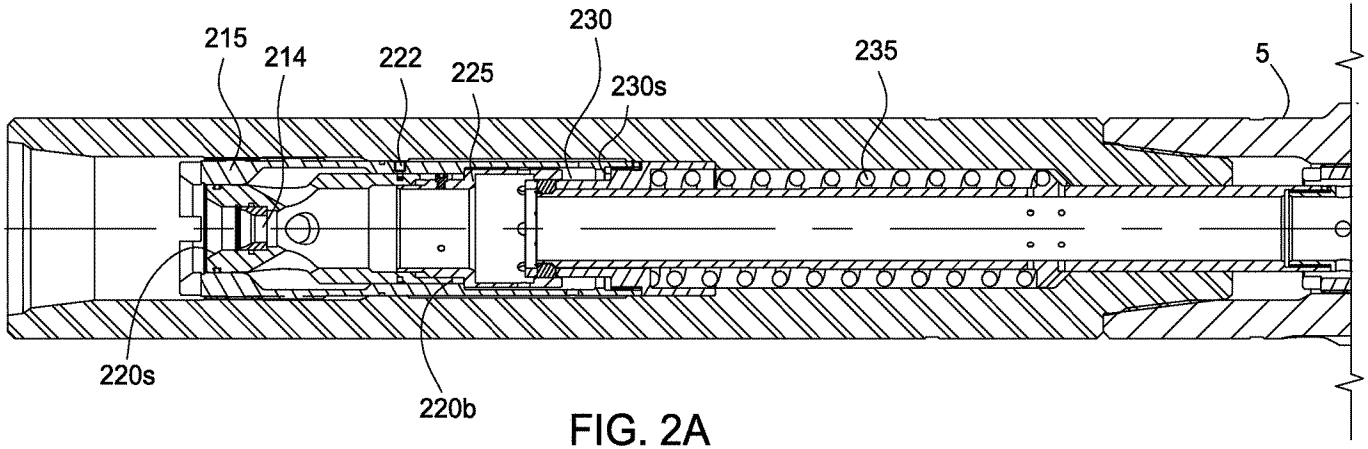

FIGS. 2A and 2B are cross-sections of a mechanical control module 200 connected to the underreamer 100 in a retracted and extended position, respectively, according to another embodiment of the present invention. The control module 200 may include a body 205, a control mandrel 210, a piston housing 215, a piston 220, a keeper 225, a lock mandrel 230, and a biasing member 235. The body 205 may be tubular and have a longitudinal bore formed therethrough. Each longitudinal end 205*a,b* of the body 205 may be threaded for longitudinal and rotational coupling to other members, such as the underreamer 100 at 205*b* and a drill string at 205*a*.

The biasing member may be a spring 235 and may be disposed between a shoulder 210*s* of the control mandrel 210 and a shoulder of the lock mandrel 230. The spring 235 may bias a longitudinal end of the control mandrel or a control module adapter 212 into abutment with the underreamer piston end 10*t*, thereby also biasing the underreamer piston 210 toward the retracted position. The control module adapter 212 may be longitudinally coupled to the control mandrel 210, such as by a threaded connection, and may allow the control module 200 to be used with differently configured underreamers by changing the adapter 212. The control mandrel 210 may be longitudinally coupled to the lock mandrel 230 by a latch or lock, such as a plurality of dogs 227. Alternatively, the latch or lock may be a collet. The dogs 227 may be held in place by engagement with a lip 225*l* of the keeper 225 and engagement with a lip 210*l* of the control mandrel 210. The lock mandrel 230 may be longitudinally coupled to the piston housing 215 by a threaded connection and may abut a body shoulder 205*s* and the piston housing 215.

The piston housing 215 may be longitudinally coupled to the body 205 by a threaded connection. The piston 220 may be longitudinally coupled to the keeper 225 by one or more fasteners, such as set screws 224, and by engagement of a piston end 220*b* with a keeper shoulder 225*s*. The set screws 224 may each be disposed through a respective slot formed through a wall of the piston 220 so that the piston may move longitudinally relative to the keeper 225, the movement limited by a length of the slot. The keeper 225 may be longitudinally movable relative to the body 205, the movement limited by engagement of the keeper shoulder 225*s* with a piston housing shoulder 215*s* and engagement of a keeper longitudinal end with a lock mandrel shoulder 230*s*. The piston 220 may be longitudinally coupled to the piston housing 215 by one or more frangible fasteners, such as shear screws 222. The piston 220 may have a seat 220*s* formed therein for receiving a closure element, such as a ball 290, plug, or dart. A nozzle 214 may be disposed in a bore of the piston 220 and made from an erosion resistant material, such as a metal, alloy, ceramic, or cermet.

When deploying the underreamer 100 and control module 200 in the wellbore, a drilling operation (e.g., drilling through a casing shoe) may be performed without operation of the underreamer 100. Even though force is exerted on the underreamer piston 10 by drilling fluid, the shear screws 222 may prevent the underreamer piston 10 from extending the arms 50*a,b*. When it is desired to operate the underreamer 100, the ball 290 is pumped or dropped from the surface and lands in the ball seat 220*s*. Drilling fluid continues to be injected or is injected through the drill string. Due to the obstructed piston bore, fluid pressure acting on the ball 290 and piston 220 increases until the shear screws 222 are fractured, thereby allowing the piston to move longitudinally relative to the body 205. The piston end 220*b* may then engage the keeper shoulder 225*s* and push the keeper 225 longitudinally relative to the body 205, thereby disengaging the keeper lip 225*l* from the dogs 227. The control mandrel lip 210*l* may be inclined and force exerted on the control mandrel 210 by the underreamer piston 10 may push the dogs 227 radially outward into a radial gap defined between the lock mandrel 230 and the keeper 225, thereby freeing the control mandrel and allowing the underreamer piston 10 to extend the arms 50*a,b*. Movement of the piston 220 may also expose a piston housing bore and place bypass ports 220*p* formed through a wall of the piston 220 in fluid communication therewith.

Figure 3:
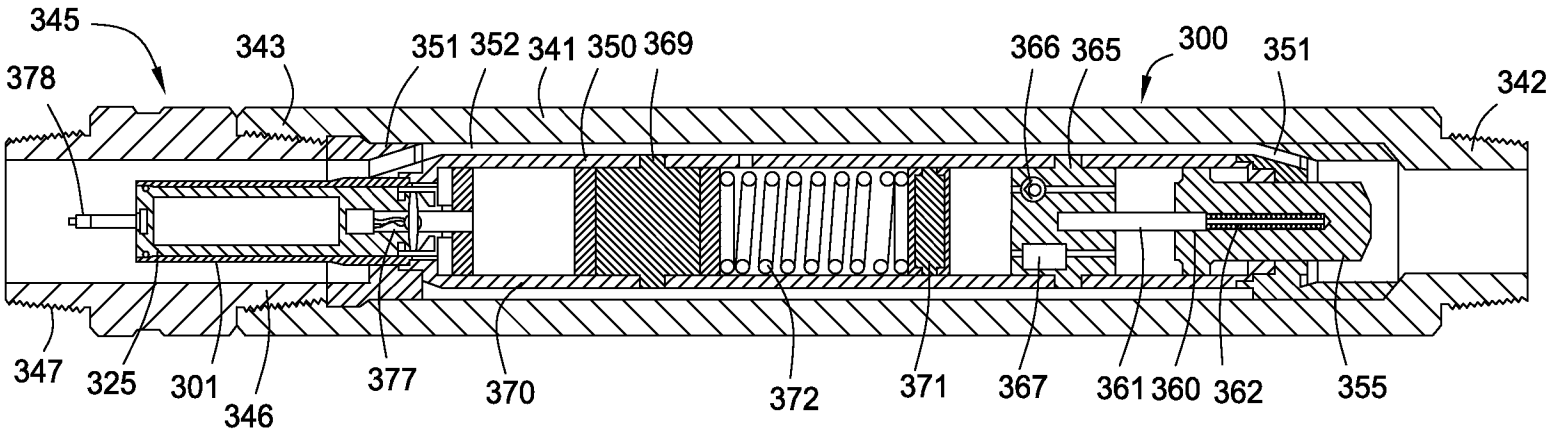
FIG. 3 illustrates an electro-hydraulic control module for use with the underreamer, according to another embodiment of the present invention.

FIG. 3 illustrates an electro-hydraulic control module 300 for use with the underreamer 100, according to another embodiment of the present invention. The control module 300 may be used instead of the control module 200. The control module 300 may include an outer tubular body 341.

The lower end of the body 341 may include a threaded coupling, such as pin 342, connectable to the threaded end 5*a* of the underreamer 100. The upper end of the body 341 may include a threaded coupling, such as box 343, connected to a threaded coupling, such as lower pin 346, of the retainer 345. The retainer 345 may have threaded couplings, such as pins 346 and 347, formed at its ends. The upper pin 347 may connect to a threaded coupling, such as box 408*b*, of a telemetry sub 400.

The tubular body 341 may house an interior tubular body 350. The inner body 350 may be concentrically supported within the tubular body 341 at its ends by support rings 351. The support rings 351 may be ported to allow drilling fluid flow to pass into an annulus 352 formed between the two bodies 341, 350. The lower end of tubular body 350 may slidingly support a positioning piston 355, the lower end of which may extend out of the body 350 and may engage piston end 10*t*.

The interior of the piston 355 may be hollow in order to receive a longitudinal position sensor 360. The position sensor 360 may include two telescoping members 361 and 362. The lower member 362 may be connected to the piston 355 and be further adapted to travel within the first member 361. The amount of such travel may be electronically measured. The position sensor 360 may be a linear potentiometer. The upper member 361 may be attached to a bulkhead 365 which may be fixed within the tubular body 350.

The bulkhead 365 may have a solenoid operated valve 366 and passage extending therethrough. The bulkhead 365 may further include a pressure switch 367 and passage. A conduit tube (not shown) may be attached at its lower end to the bulkhead 365 and at its upper end to and through a second bulkhead 369 to provide electrical communication for the position sensor 360, the solenoid valve 366, and the pressure switch 367, to a battery pack 370 located above the second bulkhead 369. The batteries may be high temperature lithium batteries. A compensating piston 371 may be slidingly positioned within the body 350 between the two bulkheads 365,369. A spring 372 may be located between the piston 371 and the second bulkhead 369, and the chamber containing the spring may be vented to allow the entry of drilling fluid.

A tube 301 may be disposed in the connector sub 345 and may house an electronics package 325. The electronics package 325 may include a controller, such as microprocessor, power regulator, and transceiver. Electrical connections 377 may be provided to interconnect the power regulator to the battery pack 370. A data connector 378 may be provided for data communication between the microprocessor 325 and the telemetry sub 400. The data connector may include a short-hop electromagnetic telemetry antenna 378.

Hydraulic fluid (not shown), such as oil, may be disposed in a lower chamber defined by the positioning piston 355, the bulkhead 365, and the body 350 and an upper chamber defined by the compensating piston 371, the bulkhead 365, and the body 350. The spring 372 may bias the compensating piston 371 to push hydraulic oil from the upper reservoir, through the bulkhead passage and valve, thereby extending the positioning piston into engagement with the underreamer piston 10 and biasing the underreamer piston toward the retracted position. Alternatively, the underreamer 100 may include its own return spring and the spring 372 may be used maintain engagement of the positioning piston 355 with the underreamer piston 10. The solenoid valve 366 may be a check valve operable between a closed position where the valve functions as a check valve oriented to prevent flow from the lower chamber to the upper chamber and allow reverse flow therethrough, thereby fluidly locking the underreamer 100 in the retracted position and an open position where the valve allows flow through the passage (in either direction). Alternatively, a solenoid operate shutoff valve may be used instead of the check valve. To allow extension of the underreamer 100, the valve 366 may be opened when drilling fluid is flowing. The underreamer piston 10 may then actuate and push the positioning piston 355 toward the lower bulkhead 365.

The position sensor 360 may measure the position of the piston 355. The controller 325 may monitor the sensor 360 to verify that the piston 355 has been actuated. The differential pressure switch 367 in the lower bulkhead 365 may verify that the underreamer piston 10 has made contact with the positioning piston 355. The force exerted on the piston 355 by the underreamer piston 310 may cause a pressure increase on that side of the bulkhead. Additionally, the underreamer 100 may be modified to be variable (see section mill 1100) and the controller 325 may close the valve 366 before the underreamer arms 50*a,b* are fully extended, thereby allowing the underreamer 100 to have one or more intermediate positions. Additionally, the controller may lock and unlock the underreamer 100 repeatedly.

In operation, the control module 300 may receive an instruction signal from the surface (discussed below). The instruction signal may direct the control module 300 to allow full or partial extension of the arms 50*a,b*. The controller 325 may open the solenoid valve 366. If drilling fluid is being circulated through the BHA, the underreamer piston 10 may then extend the arms 50*a,b*. During extension, the controller 325 may monitor the arms using the pressure sensor 367 and the position sensor 361. Once the arms have reached the instructed position, the controller 325 may close the valve 366, thereby preventing further extension of the arms. The controller 325 may then report a successful extension of the arms or an error if the arms are obstructed from the instructed extension. Once the underreamer operation has concluded, the control module 300 may receive a second instruction signal to retract the arms. If the valve 366 is the check valve, the controller may open the valve or may not have to take action as the check valve may allow for hydraulic fluid to flow from the upper chamber to the lower chamber regardless of whether the valve is open or closed. The controller may simply monitor the position sensor and report successful retraction of the arms. If the valve 366 is a shutoff valve, the instruction signal may include a time at which the rig pumps are shut off or the controller 325 may wait for indication from the telemetry sub that the rig pumps are shut off. The controller may then open the valve to allow the retraction of the arms. Since the control module may not force retraction of the arms 50*a,b* the control module may be considered a passive control module. Advantageously, the passive control module may use less energy to operate than an active control module (discussed below).

As shown, components of the control module 300 are disposed in a bore of the body 341 and connector 345. Alternatively, components of the control module may be disposed in a wall of the body 341, similar to the telemetry sub 400. The center configured control module 300 may allow for: stronger outer collar connections, a single size usable for different size underreamers or other downhole tools, and easier change-out on the rig floor. The annular alternative arranged control module may provide a central bore therethrough so that tools, such as a ball, may be run-through or dropped through the drill string.

In one embodiment, an optional latch, such as a collet, may be formed in an outer surface of the position piston 355. A corresponding profile may be formed in an inner surface of the interior body 350. The latch may engage the profile when the position piston is in the retracted position. The latch may transfer at least a substantial portion of the underreamer piston 10 force to the interior body 350 when drilling fluid is injected through the underreamer 100, thereby substantially reducing the amount of pressure required in the lower hydraulic chamber to restrain the underreamer piston.

Figure 4:
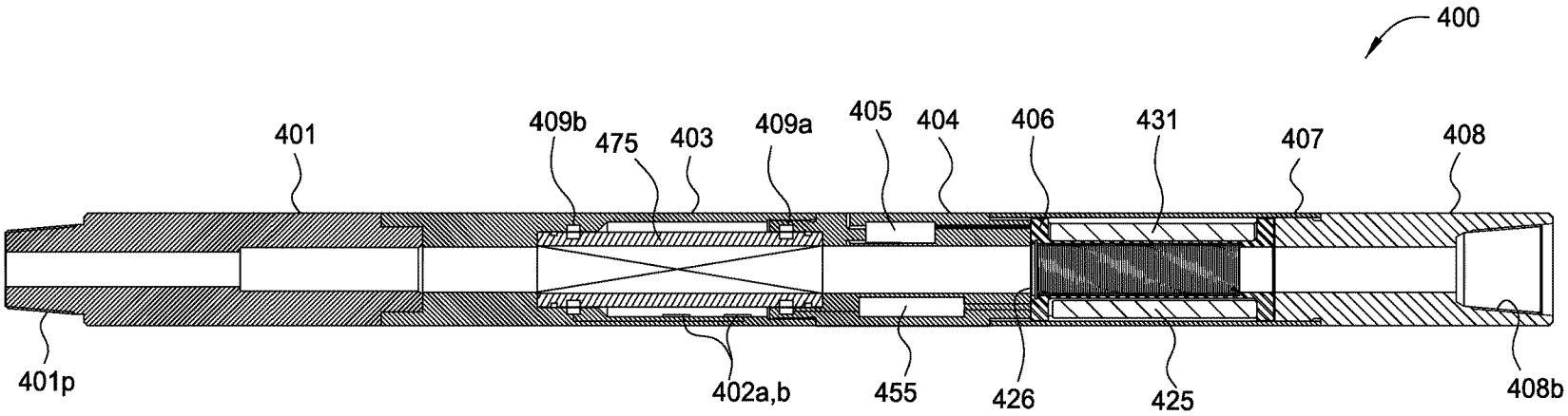
FIG. 4 illustrates a telemetry sub for use with the control module, according to another embodiment of the present invention.

FIG. 4 illustrates a telemetry sub 400 for use with the control module 300, according to another embodiment of the present invention. The telemetry sub 400 may include an upper adapter 408, one or more auxiliary sensors 402*a,b*, an uplink housing 403, a sensor housing 404, a pressure sensor 405, a downlink mandrel 406, a downlink housing 407, a lower adapter 401, one or more data/power couplings 409*a,b*, an electronics package 425, an antenna 426, a battery 431, accelerometers 455, and a mud pulser 475. The housings 403, 404, 407 may each be modular so that any of the housings 403, 404, 407 may be omitted and the rest of the housings may be used together without modification thereof. Alternatively, any of the sensors or electronics of the telemetry sub 400 may be incorporated into the control module 300 and the telemetry sub 400 may be omitted.

The adapters 401,408 may each be tubular and have a threaded coupling 401*p*, 408*b* formed at a longitudinal end thereof for connection with the control module 300 and the drill string. Each housing may be longitudinally and rotationally coupled together by one or more fasteners, such as screws (not shown), and sealed by one or more seals, such as o-rings (not shown).

The sensor housing 404 may include the pressure sensor 405 and a tachometer 455. The pressure sensor 405 may be in fluid communication with a bore of the sensor housing via a first port and in fluid communication with the annulus via a second port. Additionally, the pressure sensor 405 may also measure temperature of the drilling fluid and/or returns. The sensors 405,455 may be in data communication with the electronics package 425 by engagement of contacts disposed at a top of the mandrel 406 with corresponding contacts disposed at a bottom of the sensor housing 406. The sensors 405,455 may also receive electricity via the contacts. The sensor housing 404 may also relay data between the mud pulser 475, the auxiliary sensors 402*a,b*, and the electronics package 425 via leads and radial contacts 409*a,b*.

The auxiliary sensors 402*a,b* may be magnetometers which may be used with the accelerometers for determining directional information, such as azimuth, inclination, and/or tool face/bent sub angle.

The antenna 426 may include an inner liner, a coil, and an outer sleeve disposed along an inner surface of the downlink mandrel 406. The liner may be made from a non-magnetic and non-conductive material, such as a polymer or composite, have a bore formed longitudinally therethrough, and have a helical groove formed in an outer surface thereof. The coil may be wound in the helical groove and made from an electrically conductive material, such as a metal or alloy. The outer sleeve may be made from the non-magnetic and non-conductive material and may be insulate the coil from the downlink mandrel 406. The antenna 426 may be longitudinally and rotationally coupled to the downlink mandrel 406 and sealed from a bore of the telemetry sub 400.

Figure 4A:
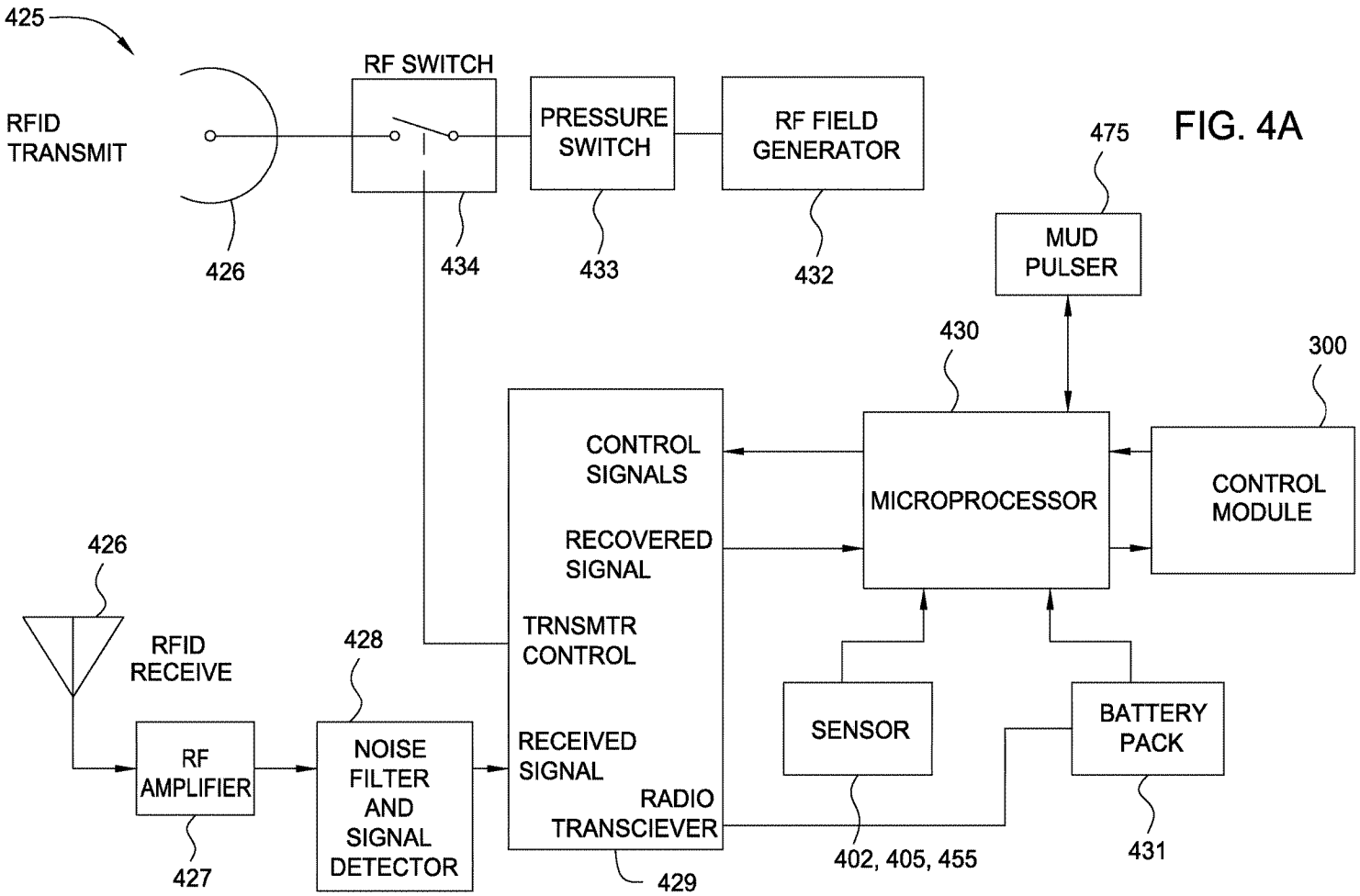
FIG. 4A illustrates an electronics package of the telemetry sub.
Figure 4B:
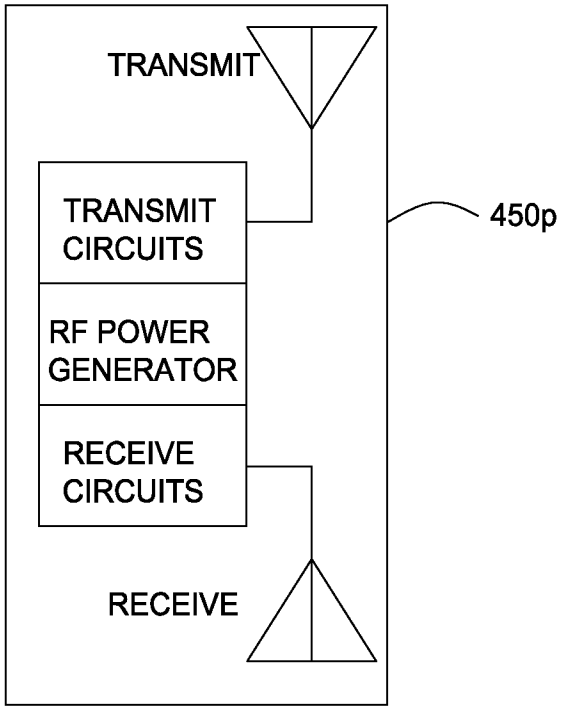
FIG. 4B illustrates an active RFID tag and a passive RFID tag for use with the telemetry sub.
Figure 4B:
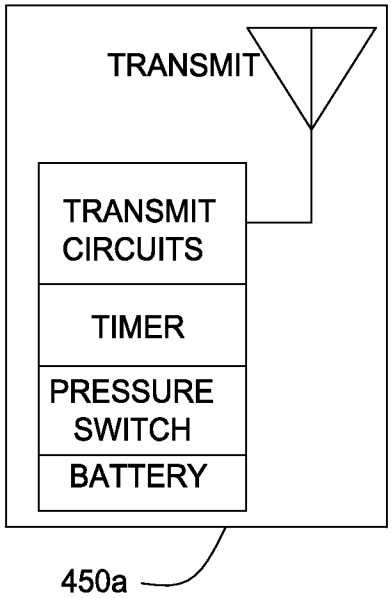

FIG. 4A illustrates the electronics package 425. FIG. 4B illustrates an active RFID tag 450*a* and a passive RFID tag 450*p*. The electronics package 425 may communicate with a passive RFID tag 450*p* or an active RFID tag 450*a*. Either of the RFID tags 450*a,p* may be individually encased and dropped or pumped through the drill string. The electronics package 425 may be in electrical communication with the antenna 426 and receive electricity from the battery 431. Alternatively, the data sub 400 may include a separate transmitting antenna and a separate receiving antenna. The electronics package 425 may include an amplifier 427, a filter and detector 428, a transceiver 429, a microprocessor 430, an RF switch 434, a pressure switch 433, and an RF field generator 432.

The pressure switch 433 may remain open at the surface to prevent the electronics package 425 from becoming an ignition source. Once the data sub 400 is deployed to a sufficient depth in the wellbore, the pressure switch 433 may close. The microprocessor 430 may also detect deployment in the wellbore using pressure sensor 405. The microprocessor 430 may delay activation of the transmitter for a predetermined period of time to conserve the battery 431.

When it is desired to operate the underreamer 100, one of the tags 450*a,p* may be pumped or dropped from the surface to the antenna 426. If a passive tag 450*p* is deployed, the microprocessor 430 may begin transmitting a signal and listening for a response. Once the tag 450*p* is deployed into proximity of the antenna 426, the passive tag 450*p* may receive the signal, convert the signal to electricity, and transmit a response signal. The antenna 426 may receive the response signal and the electronics package 425 may amplify, filter, demodulate, and analyze the signal. If the signal matches a predetermined instruction signal, then the microprocessor 430 may communicate the signal to the underreamer control module 300 using the antenna 426 and the transmitter circuit. The instruction signal carried by the tag 450*a,p* may include an address of a tool (if the BHA includes multiple underreamers and/or stabilizers, discussed below) and a set position (if the underreamer/stabilizer is adjustable).

If an active tag 450*a* is used, then the tag 450*a* may include its own battery, pressure switch, and timer so that the tag 450*a* may perform the function of the components 432-434. Further, either of the tags 450*a,p* may include a memory unit (not shown) so that the microprocessor 430 may send a signal to the tag and the tag may record the signal. The signal may then be read at the surface. The signal may be confirmation that a previous action was carried out or a measurement by one of the sensors. The data written to the RFID tag may include a date/time stamp, a set position (the command), a measured position (of control module position piston), and a tool address. The written RFID tag may be circulated to the surface via the annulus.

Alternatively, the control module 300 may be hard-wired to the telemetry sub 400 and a single controller, such as a microprocessor, disposed in either sub may control both subs. The control module 300 may be hard-wired by replacing the data connector 378 with contact rings disposed at or near the pin 347 and adding corresponding contact rings to/near the box 408*b* of the telemetry sub 400. Alternatively, inductive couplings may be used instead of the contact rings. Alternatively, a wet or dry pin and socket connection may be used instead of the contact rings.

Figure 4D:
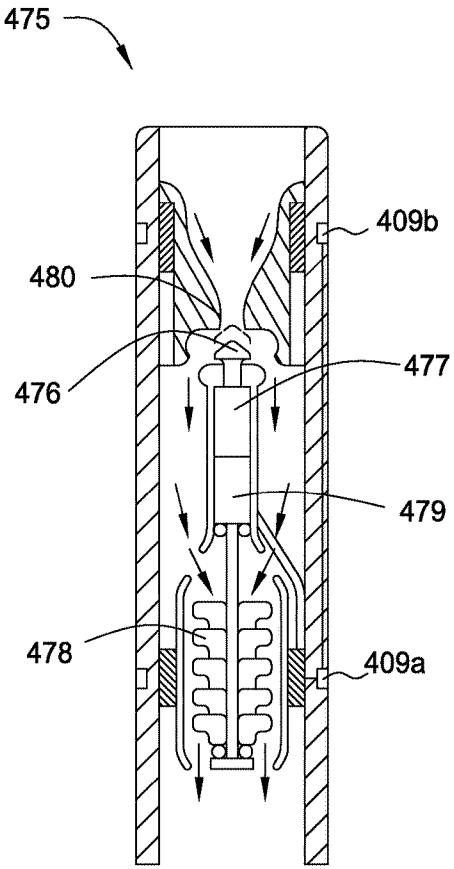
FIG. 4D illustrates a mud pulser of the telemetry sub.
Figure 4C:
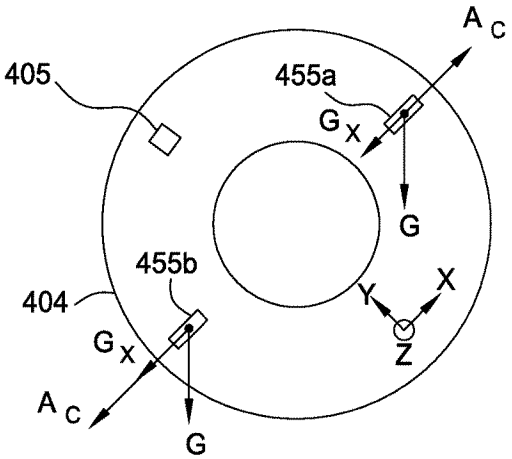
FIG. 4C illustrates accelerometers of the telemetry sub.

FIG. 4C is a schematic cross-sectional view of the sensor sub 404. The tachometer 455 may include two diametrically opposed single axis accelerometers 455*a,b*. The accelerometers 455*a,b* may be piezoelectric, magnetostrictive, servo-controlled, reverse pendular, or microelectromechanical (MEMS). The accelerometers 455*a,b* may be radially X oriented to measure the centrifugal acceleration $A_c$ due to rotation of the telemetry sub 400 for determining the angular speed. The second accelerometer may be used to account for gravity G if the telemetry sub is used in a deviated or horizontal wellbore. Detailed formulas for calculation of the angular speed are discussed and illustrated in U.S. Pat. App. Pub. No. 2007/0107937, which is herein incorporated by reference in its entirety. Alternatively, as discussed in the '937 publication, the accelerometers may be tangentially Y oriented, dual axis, and/or asymmetrically arranged (not diametric and/or each accelerometer at a different radial location). Further, as discussed in the '937 publication, the accelerometers may be used to calculate borehole inclination and gravity tool face. Further, the sensor sub may include a longitudinal Z accelerometer. Alternatively, magnetometers may be used instead of accelerometers to determine the angular speed.

Instead of using one of the RFID tags 450*a,p* to activate the underreamer 100, an instruction signal may be sent to the controller 430 by modulating angular speed of the drill string according to a predetermined protocol. The protocol may represent data by varying the angular speed on to off, a lower speed to a higher speed and/or a higher speed to a lower speed, monotonically increasing from a lower speed to a higher speed and/or a higher speed to a lower speed, maintaining speed for a period of time, and combinations thereof. The modulated angular speed may be detected by the tachometer 455. The controller 430 may then demodulate the signal and relay the signal to the control module controller 325, thereby operating the underreamer 100.

FIG. 4D illustrates the mud pulser 475. The mud pulser 475 may include a valve, such as a poppet 476, an actuator 477, a turbine 478, a generator 479, and a seat 480. The poppet 476 may be longitudinally movable by the actuator 477 relative to the seat 480 between an open position (shown) and a choked position (dashed) for selectively restricting flow through the pulser 475, thereby creating pressure pulses in drilling fluid pumped through the mud pulser. The mud pulses may be detected at the surface, thereby communicating data from the microprocessor to the surface. The turbine 478 may harness fluid energy from the drilling fluid pumped therethrough and rotate the generator 479, thereby producing electricity to power the mud pulser. The mud pulser may be used to send confirmation of receipt of commands and report successful execution of commands or errors to the surface. The confirmation may be sent during circulation of drilling fluid. Alternatively, a negative or sinusoidal mud pulser may be used instead of the positive mud pulser 475. The microprocessor may also use the turbine 478 and/or pressure sensor as a flow switch and/or flow meter.

Instead of using one of the RFID tags 450*a,p* or angular speed modulation to activate the underreamer 100, a signal may be sent to the controller by modulating a flow rate of the rig drilling fluid pump according to a predetermined protocol. Alternatively, a mud pulser (not shown) may be installed in the rig pump outlet and operated by the surface controller to send pressure pulses from the surface to the telemetry sub controller according to a predetermined protocol. The telemetry sub controller may use the turbine and/or pressure sensor as a flow switch and/or flow meter to detect the sequencing of the rig pumps/pressure pulses. The flow rate protocol may represent data by varying the flow rate on to off, a lower speed to a higher speed and/or a higher speed to a lower speed, or monotonically increasing from a lower speed to a higher speed and/or a higher speed to a lower speed. Alternatively, an orifice flow switch or meter may be used to receive pressure pulses/flow rate signals communicated through the drilling fluid from the surface instead of the turbine and/or pressure sensor. Alternatively, the sensor sub may detect the pressure pulses/flow rate signals using the pressure sensor and accelerometers to monitor for BHA vibration caused by the pressure pulse/flow rate signal.

Figure 5A:
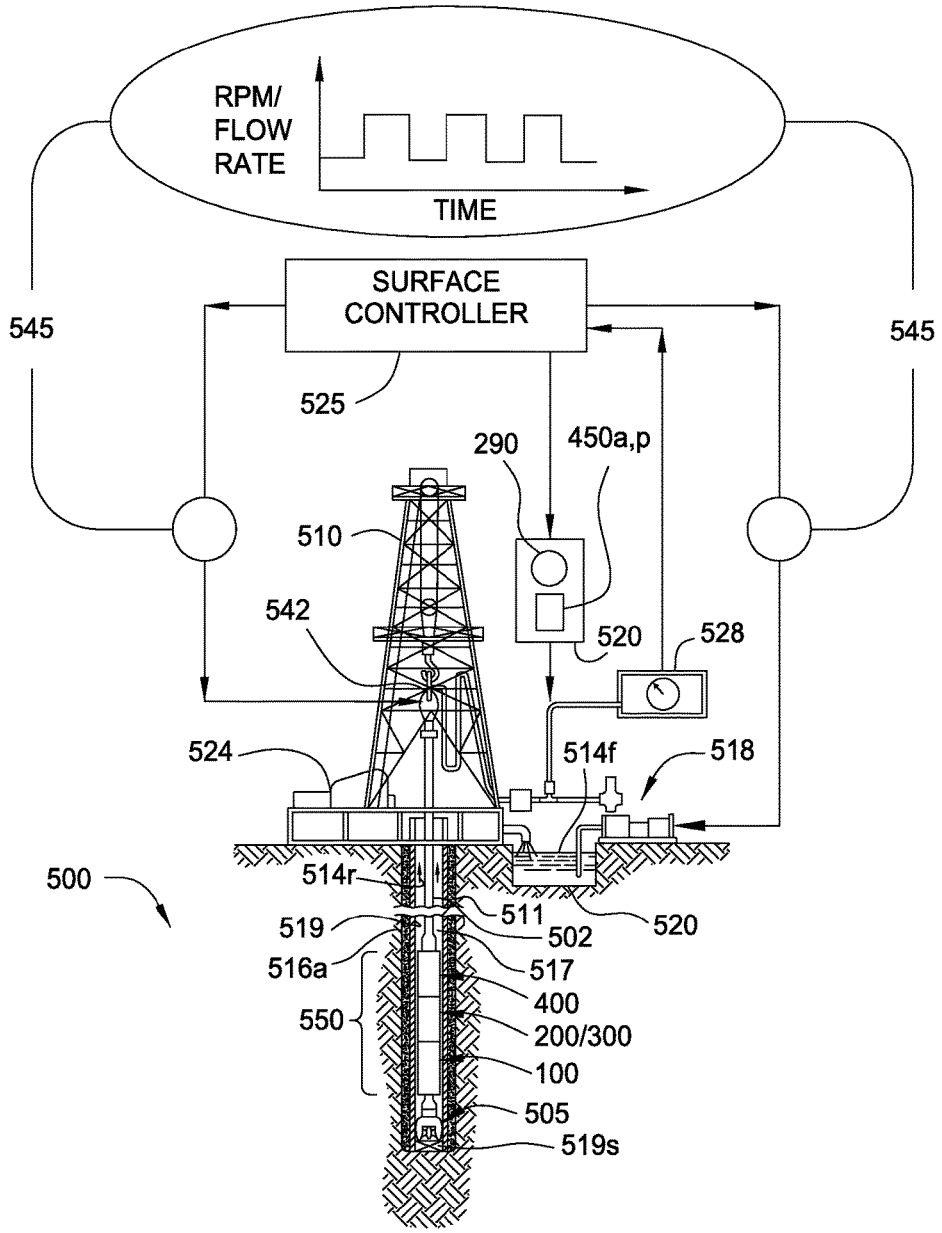
FIGS. 5A and 5B illustrate a drilling system and method utilizing the underreamer, according to another embodiment of the present invention.
Figure 5B:
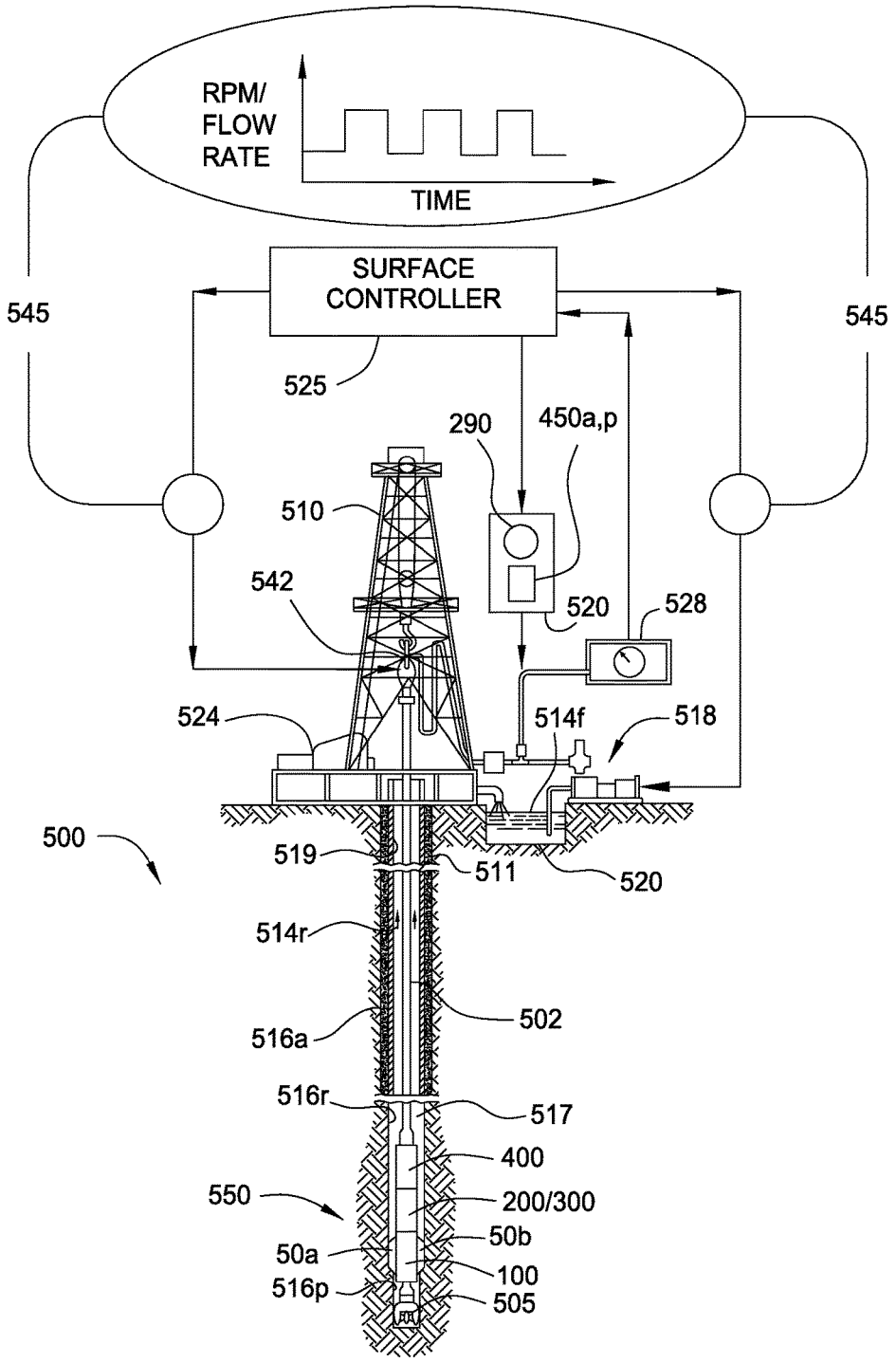

FIGS. 5A and 5B illustrate a drilling system 500 and method utilizing the underreamer 100, according to another embodiment of the present invention.

The drilling system 500 may include a drilling derrick 510. The drilling system 500 may further include drawworks 524 for supporting a top drive 542. The top drive 542 may in turn support and rotate a drilling assembly 500. Alternatively, a Kelly and rotary table (not shown) may be used to rotate the drilling assembly instead of the top drive. The drilling assembly 500 may include a drill string 502 and a bottomhole assembly (BHA) 550. The drill string 502 may include joints of threaded drill pipe connected together or coiled tubing. The BHA 550 may include the telemetry sub 400, the control module 300, the underreamer 100, and a drill bit 505. A rig pump 518 may pump drilling fluid, such as mud 514*f*, out of a pit 520, passing the mud through a stand pipe and Kelly hose to a top drive 542. The mud 514*f* may continue into the drill string, through a bore of the drill string, through a bore of the BHA, and exit the drill bit 505. The mud 514*f* may lubricate the bit and carry cuttings from the bit. The drilling fluid and cuttings, collectively returns 514*r*, flow upward along an annulus 517 formed between the drill string and the wall of the wellbore 516*a*/casing 519, through a solids treatment system (not shown) where the cuttings are separated. The treated drilling fluid may then be discharged to the mud pit for recirculation.

The drilling system may further include a launcher 520, surface controller 525, and a pressure sensor 528. The pressure sensor 528 may detect mud pulses sent from the telemetry sub 400. The surface controller 525 may be in data communication with the rig pump 518, launcher 520, pressure sensor 528, and top drive 542. The rig pump 518 and/or top drive 542 may include a variable speed drive so that the surface controller 525 may modulate 545 a flow rate of the rig pump 518 and/or an angular speed (RPM) of the top drive 542. The modulated signal may be a square wave, trapezoidal wave, sinusoidal wave, or other suitable waves. Alternatively, the controller 545 may modulate the rig pump and/or top drive by simply switching them on and off.

A first section of a wellbore 516*a* has been drilled. A casing string 519 has been installed in the wellbore 516*a* and cemented 511 in place. A casing shoe 519*s* remains in the wellbore. The drilling assembly 500 may then be deployed into the wellbore 516*a* until the drill bit 505 is proximate the casing shoe 519*s*. The drill bit 505 may then be rotated by the top drive and mud injected through the drill string by the rig pump. Weight may be exerted on the drill bit, thereby causing the drill bit to drill through the casing shoe. The underreamer 100 may be restrained in the retracted position by the control module 200/300. Once the casing shoe 519*s* has been drilled through and the underreamer 100 is in a pilot section 516*p* of the wellbore, the underreamer 100 may be extended. If the control module 200 is used, then the surface controller 525 may instruct the launcher 520 to deploy the ball 290. If the control module 300 is used, then the surface controller 525 may instruct the launcher 520 to deploy one of the RFID tags 450*a,p*; modulate angular speed of the top drive 545; or flow rate of the rig pump 518, thereby conveying an instruction signal to extend the underreamer 100. Alternatively, the ball 290/RFID tags 450*a,p* may be manually launched. The telemetry sub 400 may receive the instruction signal; relay the instruction signal to the control module 300 allow the arms 50*a,b* to extend; and send a confirmation signal to the surface via mud pulse. The pressure sensor 528 may receive the mud pulse and communicate the mud pulse to the surface controller. The underreamer 100 may then ream the pilot section 516*p* into a reamed section 516*r*, thereby facilitating installation of a larger diameter casing/liner upon completion of the reamed section.

Alternatively, instead of drilling through the casing shoe, a sidetrack may be drilled or the casing shoe may have been drilled during a previous trip.

Once drilling and reaming are complete, it may be desirable to perform a cleaning operation to clear the wellbore 516*r* of cuttings in preparation for cementing a second string of casing. A second instruction signal may sent to the telemetry sub 400 commanding retraction of the arms. The rig pump may be shut down, thereby allowing the control module 300 to retract the arms and lock the arms in the retracted position. Once the arms are retracted, the rig pump may resume circulation of drilling fluid and the telemetry sub may confirm retraction of the arms via mud pulse. Once the confirmation is received at the surface, the cleaning operation may commence. The cleaning operation may involve rotation of the drill string at a high angular velocity that may otherwise damage the arms if they are extended. The drilling assembly may be removed from the wellbore during the cleaning operation. Additionally, the control module 300 may be commanded to retract and lock the arms for other wellbore operations, such as underreaming only a selected portion of the wellbore. Alternatively, the drill string may remain in the wellbore during the cleaning operation and then the arms may be re-extended by sending another instruction signal and the wellbore may be back-reamed while removing the drill string from the wellbore. The arms may then be retracted again when reaching the casing shoe. Alternatively, the cleaning operation may be omitted. Alternatively or additionally, the cleaning operation may be occasionally or periodically performed during the drilling and reaming operation.

Figure 6:
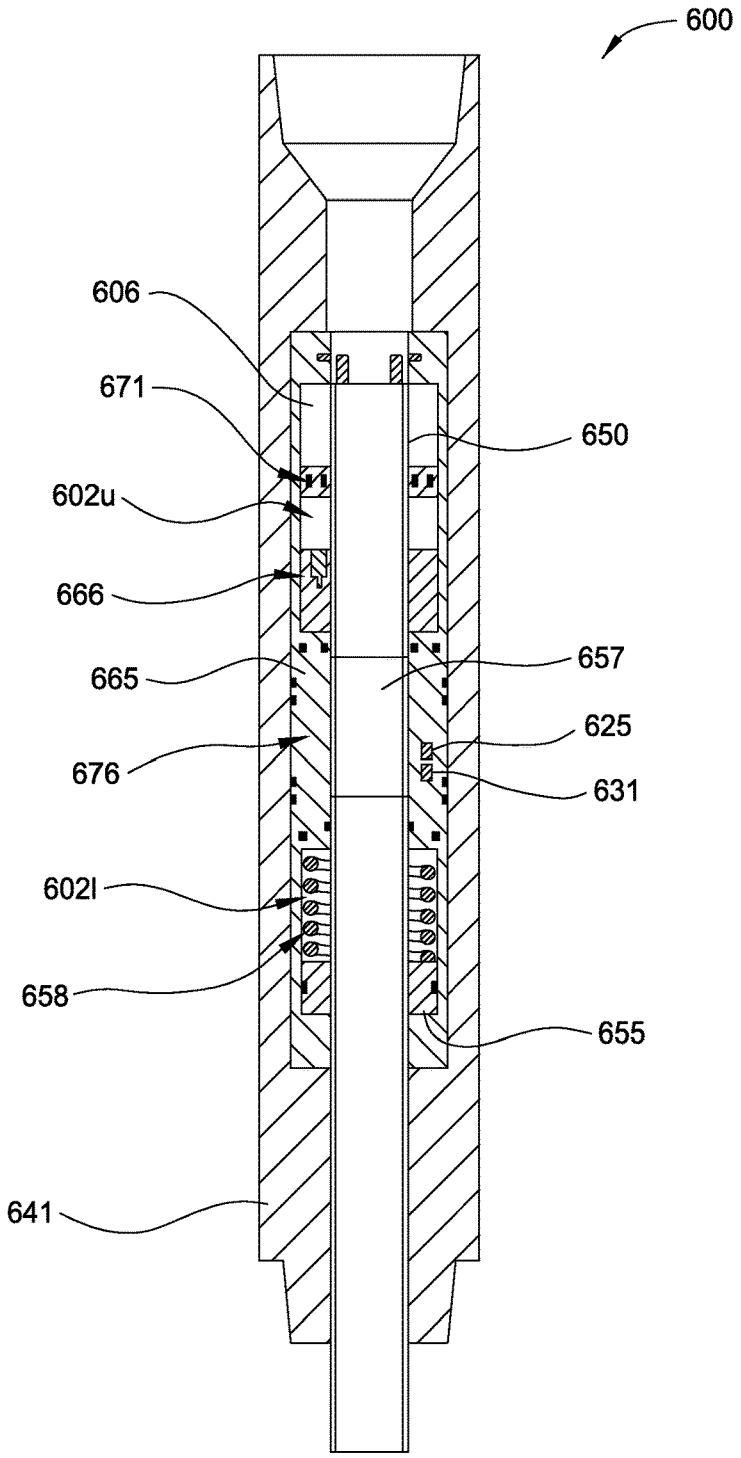
FIG. 6 illustrates another embodiment of a control module for use with the underreamer.

FIG. 6 illustrates a portion of an alternative control module 600 for use with the underreamer 100, according to another embodiment of the present invention. FIG. 6 shows the control module 600 in the closed position. The rest of the control module 600 may be similar to the control module 300. The control module 600 may be used instead of the control module 300.

The control module 600 may include an outer tubular body 641. The lower end of the body 641 may include a threaded coupling, such as a pin, connectable to the threaded end 5*a* of the underreamer 100. The upper end of the body 641 may include a threaded coupling, such as a box, connected to a threaded coupling, such as the drill string.

The tubular body 641 may house an interior tubular body 650. The inner body 650 may be concentrically supported within the outer tubular body 641. In one embodiment, a balance piston 671 is disposed between an annulus 644 formed between the two bodies 641, 650. Drilling fluid is allowed to flow into the annulus above the balance piston 671. An upper hydraulic reservoir 602*u* is formed in the annulus below the balance piston 671 and houses a hydraulic fluid. The interior tubular body 650 may include a central bore. A positioning piston 655 is disposed at the lower end of and may extend out of the tubular body 641. The positioning piston 655 may engage piston end 10*t*. A flange of the piston 655 sealingly engages an inner surface of the interior tubular body 650. A lower hydraulic chamber 602*l* is defined in an annular area between the piston 655 and the interior tubular body 650. A biasing member 658, such as a spring, may be used to bias the piston 655 in the extended position, as shown. The lower end of the piston 655 may be coupled to an extension sleeve. In another embodiment, the extension sleeve in integral with the piston 655. A bulkhead 665 is coupled to the inner tubular body 650 and the positioning piston 655. A central bore 657 extends through the exterior tubular body 641, the interior tubular body 650, the bulkhead 665, and the positioning piston 655. The bulkhead 665 may have a hydraulic passage 676 to allow selective fluid communication between the lower hydraulic chamber 602*l* and the upper hydraulic chamber 602*u*. In this embodiment, a solenoid valve 666 is used to control fluid communication through the hydraulic passage 676. The bulkhead 665 may further include pressure sensors for measuring the pressure in the lower hydraulic chamber 602*l* and the pressure in the upper hydraulic chamber.

The compensating piston 671 may be slidingly positioned within the annulus between the interior tubular body 650 and the exterior tubular body 641. The upper hydraulic chamber 602*u* is defined in an annular area between the inner conduit 601 and the interior tubular body 650 and axially between the compensating piston 671 and the bulkhead 665. The annulus above the compensating piston 671 may be referred to as a compensating chamber 606. The compensating piston 671 equalizes pressure between drilling fluid in the compensating chamber 606 and the upper chamber 602*u*.

The bulkhead 665 may house the battery 631 and an electronics package 625. The batteries 631 may be high temperature lithium batteries. The electronics package 625 may include a controller, such as microprocessor, power regulator, and transceiver. The controller may be configured to receive data from the sensors. The electronics package may further include sufficient electronic components for RFID communication with either an active RFID tag or a passive RFID tag. The module 600 also includes an antenna 626 for RFID communication.

In one embodiment, the solenoid valve 666 is operable to prevent flow from the lower chamber to the upper chamber in the closed position. Suitable solenoid valves 666 include a check valve or a shutoff valve. Similar to the control module 300, the position piston 655 may prevent the underreamer piston 10 from extending the arms 50*a,b* while drilling fluid 514*f* is pumped through the control module 600 and the underreamer 100 due to the closed valve 666. The control module 600 may further include a position sensor, such as a Hall sensor and magnet, which may be monitored by the controller 625 to allow extension of the arms to one or more intermediate positions and/or to confirm full extension of the arms. Alternatively, the position sensor may be a linear voltage differential transformer (LVDT).

In operation, when the controller of the control module 625 may receive a signal instructing retraction of the arms 50*a,b*, the controller 625 may open the solenoid check valve 666 so oil may flow through the hydraulic passage from the upper chamber to the lower chamber. In one embodiment, the signal is sent using a RFID tag. After the solenoid valve opens, the position piston 655 is allowed to retract, thereby allowing the underreamer arms to extend. Once the controller 625 detects that the position piston 655 is in the instructed position via the position sensor 611, 612, the controller may close the solenoid check valve.

The control module 600 may optionally include an actuator so that the control module 600 may actively move the underreamer piston 10 while the rig pump 518 is injecting drilling fluid through the control module 600 and the underreamer 100. The actuator may be a hydraulic pump in communication with the upper 602*u* and lower 602*l* hydraulic chambers via a hydraulic passage and operable to pump the hydraulic fluid from the upper chamber 602*u* to the lower chamber 602*l* while being opposed by the underreamer piston 10. An electric motor may drive the hydraulic pump. The electric motor may be reversible to cause the hydraulic pump to pump fluid from the lower chamber 602*l* to the upper chamber 602*u*. The active control module 600 may receive an instruction signal from the surface and operate the underreamer 100 without having to wait for shut down of the rig pump 518. Alternatively, the underreamer piston force may be reduced by decreasing flow rate of the drilling fluid or shutting off the rig pump before or during sending of the instruction signal.

Instead of using one of the RFID tags 450*a,p*, a signal may be sent to the controller 625 by modulating a flow rate of the rig drilling fluid pump according to a predetermined protocol. Alternatively, a mud pulser (not shown) may be installed in the rig pump outlet and operated by the surface controller to send pressure pulses from the surface to the control module 600 according to a predetermined protocol. The module controller 625 may use one or more pressure sensor as a flow switch and/or flow meter to detect the sequencing of the pressure pulses. The flow rate protocol may represent data by varying the flow rate on to off, a lower speed to a higher speed and/or a higher speed to a lower speed, or monotonically increasing from a lower speed to a higher speed and/or a higher speed to a lower speed. Alternatively, an orifice flow switch or meter may be used to receive pressure pulses/flow rate signals communicated through the drilling fluid from the surface instead of the pressure sensor. Alternatively, the control module may detect the pressure pulses/flow rate signals using the pressure sensor and accelerometers to monitor for BHA vibration caused by the pressure pulse/flow rate signal.

In one embodiment, the flow rate signal may include a trigger portion and a command portion. The trigger portion may be used to trigger the command recognition algorithm in the control module for the target tool. For example, the trigger portion may be a flow rate pattern that, when detected by the control module 600, indicates to the target tool that a new command is to be sent. For example, the trigger portion may involve flowing the fluid at or above a first flow rate and then at or below a second flow rate, or vice versa, for the same period of time for two cycles. The trigger portion prevents the receiver, e.g., the control module, from incorrectly activating the target tool. In another embodiment, the trigger portion may be determined by monitoring for a rate of change of the fluid pressure as a result of the change in flow rate. For example, during the trigger portion, the control module may monitor for a rate of change in pressure over time (i.e., slope) that is within a predetermined slope range to "trigger" the algorithm to look for the remainder of the digital command. In another example, the slope has to be bigger than a value defined in the recognition algorithm.

The command portion may be a flow rate pattern that, when detected, instructs the target tool to perform certain functions. The command portion may, for example, instruct the control module 600 to keep the solenoid valve open for a particular time period before closing. In another embodiment, the command portion may instruct the control module 600 to close the solenoid valve or close for a period of time before opening. In one embodiment, the flow rate pattern may be detected downhole as a pressure change due to the tool bore pressure being a function of flow rate, bit nozzle pressure drop, and BHA pressure drop. In another embodiment, the flow rate pattern may be detected downhole by monitoring the speed (e.g., rpm) of impeller or turbine blades or other flow sensor. In another embodiment, the signal may comprise modulating angular speed of the drill string instead of the flow rate. The angular speed may be measured using one or more accelerometers. The speed signal may also include a trigger portion and a command portion. In yet another embodiment, the signal may involve modulation of a combination of flow rate and angular speed. For example, the trigger portion may involve modulation of flow rate and the command portion may involve modulation of speed, and vice versa. In yet another embodiment, other types of modulation protocols are also contemplated. Exemplary modulation protocols include pulse width modulation, amplitude based modulation, phase shift key modulation, and frequency shift key modulation. For example, amplitude based modulation may be used by modulating the flow rate between three different flow rates. In this respect, time is not a constraint in amplitude based modulation.

Figure 7:
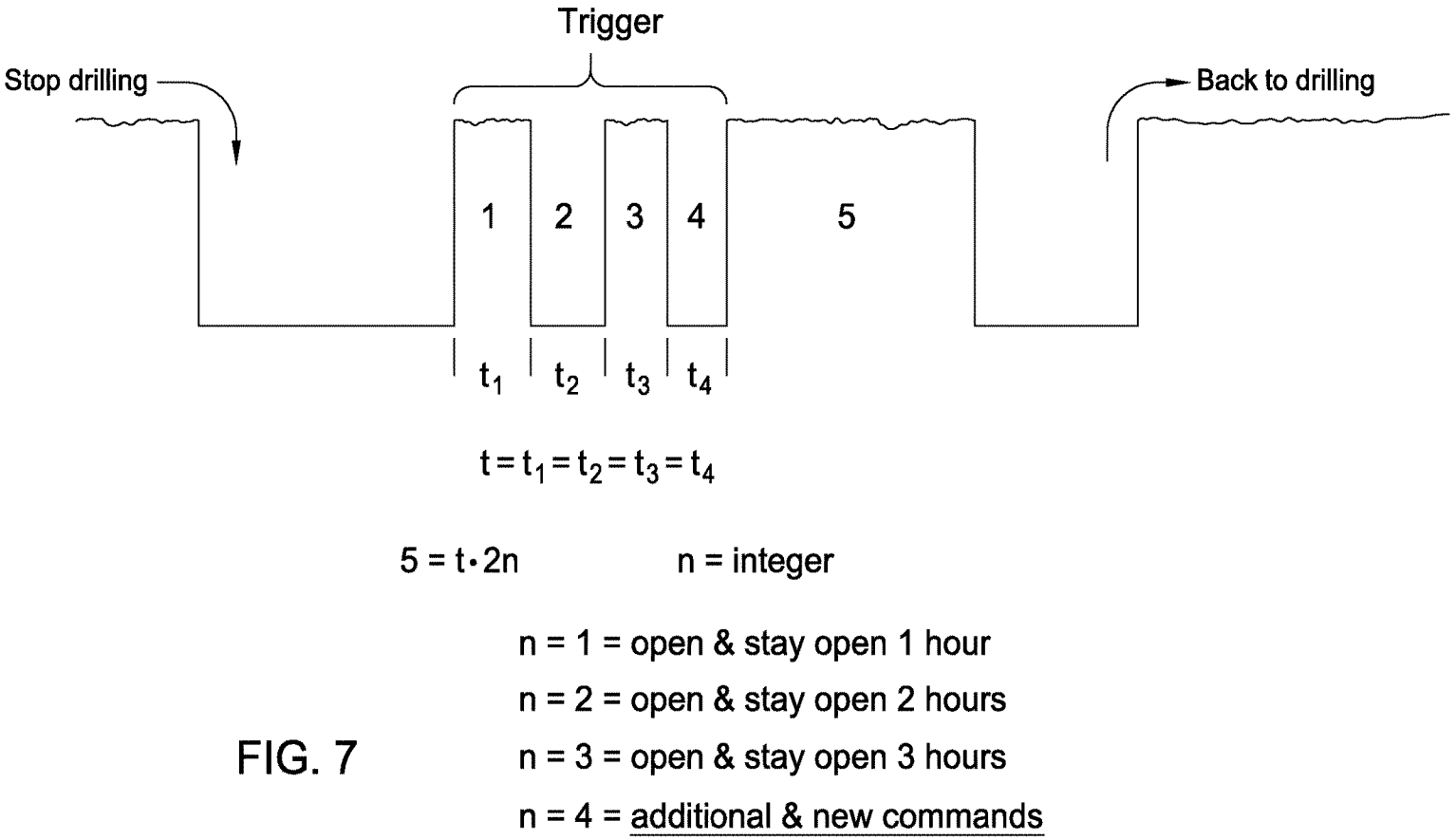
FIG. 7 illustrates an exemplary instruction signal.

FIG. 7 illustrates an exemplary flow rate modulation pattern for communicating with the control module. After drilling is stopped, the fluid flow rate is reduced to a first flow rate. To start the trigger portion, the flow rate is increased to a second flow rate and held for a specific time period (t1), as represented by area "1". Then, the flow rate is reduced to the first flow rate and held for the same period of time (t2), as represented by area "2". It is contemplated that any suitable time period may be used, for example, 30 seconds, 1 minute, 1.5 minutes, any time period from 15 seconds to 5 minutes, or any time period from 15 seconds to 20 minutes. The cycle is repeated to complete the trigger portion. The command portion instructs the control module to keep the solenoid valve for a particular time period, depending on the instruction. The valve open time period may be communicated by maintaining the flow rate for a particular time period, which is represented by area "5" in the signal of FIG. 7. In this example, area 5 is equal to t*2n, where n is an integer and each incremental increase may equate to an additional time period of the solenoid valve being open. Exemplary time periods of keeping the solenoid valve open may be any suitable time period from 15 minutes to 2 hours, such as 30 minutes or 1 hour. After the command portion, the flow rate is reduced for a period of time, and drilling may commence again. In another embodiment, command portion may comprise a particular pulse generated within the time period. For example, area "5" may represent four different time periods. If a pulse, or change in flow rate, occurs in the first time period, then the control module would be instructed to keep the solenoid valve open for the first time period, such as one hour. However, if the pulse occurs in the fourth time period, then the control module would know to keep the solenoid valve open for four time periods, such as four hours.

In one embodiment, one or more underreamers may be used in a bottom hole assembly ("BHA"). In one exemplary arrangement, the BHA may include a drill bit at the bottom, then a 3D rotary steerable system, a lower underreamer, a MWD tool, a LWD tool, an upper underreamer, and other suitable components. In this example, the lower and upper underreamers may be operated by a signal via RFID tag, flow rate modulation, and/or angular speed modulation. The lower underreamer and the upper reamer may be operated by the same of different type of signals. For example, the upper underreamer can be operated by RFID, while the lower underreamer is operated by flow rate modulation. In yet another embodiment, the upper underreamer may be a ball-drop controller and the lower underreamer may be an electro-mechanical controller. The upper underreamer may be used during drilling to underream the drilled borehole. After drilling, the lower underreamer may be used to underream the rat-hole, which is a bottom section of the wellbore between the drill bit and the upper underreamer. The rat-hole is the same diameter as the drill bit. In another embodiment, the lower underreamer could be mounted just above the drill-bit, or anywhere below the MWD pulser and/or turbine. In yet another embodiment, the lower underreamer may be mounted adjacent (either above or below) to the rotary steerable system. The upper underreamer may be mounted above the LWD tool and the MWD tool. In another embodiment, the upper underreamer may be closed prior to opening the lower underreamer or closed shortly after opening the lower underreamer.

In one embodiment, a process of forming a wellbore includes opening the upper underreamer using any of the telemetry method described herein. Optionally, the BHA may be lowered with the upper underreamer already open. The process includes simultaneously drilling using the drill bit and underreaming using the upper underreamer. After drilling, the upper underreamer may optionally be closed using any of the telemetry method described herein. To underream the rat-hole, the BHA is picked up off-bottom to a location above the rat-hole and the lower underreamer is opened using any of the telemetry method described herein. Prior to underreaming, the lower underreamer is optionally set on the ledge of the rat-hole to confirm the lower underreamer is open. Thereafter, the lower underreamer is operated to underream the rat-hole. After underreaming, one or both underreamers are optionally closed, and the BHA is pulled out of the hole.

To actuate the lower underreamer, a RFID tag may be released into the drill string. The RFID tag may flow past the upper underreamer, the LWD tool, and MWD tool, before being picked up or read by the lower underreamer. The RFID tag is configured to only actuate the lower underreamer, not the upper underreamer.

In another embodiment, the lower underreamer may be actuated by sending a flow rate signal such as the signal shown in FIG. 7. As the flow rate is modulated, the pressure in the upper hydraulic chamber 602*u* of the control module also changes. Pressure in the chamber 602*u* may be monitored by the controller to identify the trigger portion and the command portion. In another embodiment, the pressure in the lower chamber and/or the upper chamber may be monitored. In yet another embodiment, a pressure differential between both chambers may be monitored to identify the trigger signal. In yet another embodiment, a pressure change in the bore of the tool may be monitored. In yet another embodiment, the flow rate may be monitored using via impeller or turbine blades or other flow sensor. For example, the speed (e.g., revolution per minute) of the impeller may be monitored to determine a change in flow rate.

Upon receiving the command portion, the controller opens the solenoid valve 666 to allow hydraulic fluid to flow from the lower chamber 602*l* to the upper chamber 602*u*. In turn, the arms of the underreamer are allowed extend in response to fluid pressure. Extension of the arms causes the piston to retract and forces the hydraulic fluid to flow from the lower chamber 602*l* to the upper chamber 602*u*. The hydraulic fluid causes the compensating piston to move in a direction that increases the size of the upper chamber 602*u*. The command portion may also instruct the controller to close the solenoid valve after a specified period of time that is sufficient to allow the completion of the reaming process. After reaming, the drilling fluid pressure is relieved to allow the arms of the underreamer to retract. As a result, the spring in the control module biases the piston to the extended position. Also, the hydraulic fluid in the upper chamber is allowed to flow back into the lower chamber. Drilling fluid pressure in the drill string may also act on the compensating piston to facilitate the flow of hydraulic fluid back to the lower chamber.

In another embodiment, at least one of the lower underreamer and the upper underreamer may receive their respective commands from the logging while drilling tool or the rotary steerable system. The LWD tool may obtain the command from changes in the LWD bore pressure, the speed of the turbine/impeller blades, or both.

Figure 8:
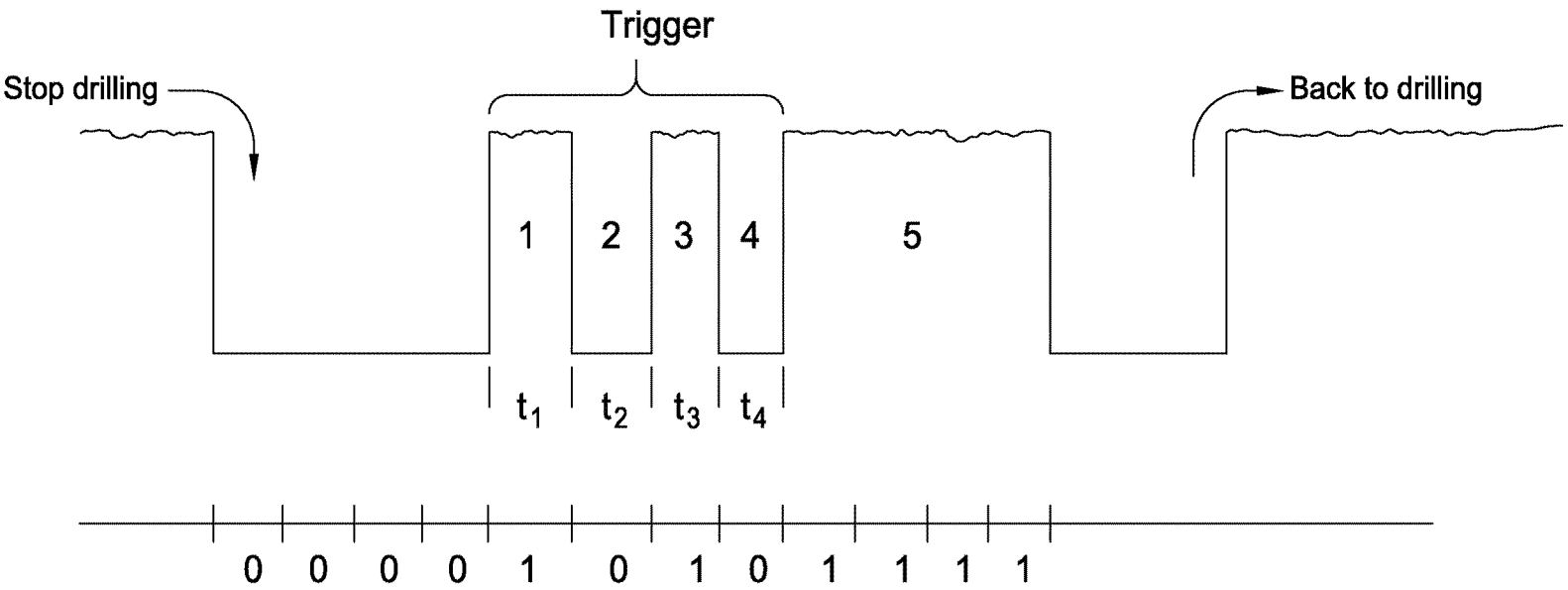
FIG. 8 illustrates an exemplary digital instruction signal.

In yet another embodiment, the flow rate modulation signal may be expressed as a digital signal. For example, referring back to FIG. 7, the flow rate signal may be divided into several equal time periods. Because the flow rate is modulated between two different flow rates, then each of the time periods may be represented by either "0" or "1". FIG. 8 is a digital representation of the signal in FIG. 7. The digital signal may be used to control the pump to modulate the flow rate. In one example, the digital bit patterns are programmed into the downhole tools prior to the downhole tools going in the wellbore. The downhole tool then monitors the pressure transducers and or accelerometers during operation and looks for its command. In yet another embodiment, the signal may be modulated using amplitude based modulation, wherein the flow rate or angular speed is modulated between three different thresholds. As a result, the digital signal may be represented based on changes in the amplitudes of the flow rates. Other suitable modulated signals include phase shift key modulation, pulse width modulation, and frequency shift key modulation. In another embodiment, the downhole tool may be configured to look for several command types (e.g., pressure or rpm) to provide redundancy. For example, if a pressure transducer failed, a backup mode may be rpm and vice versa.

Figure 9:
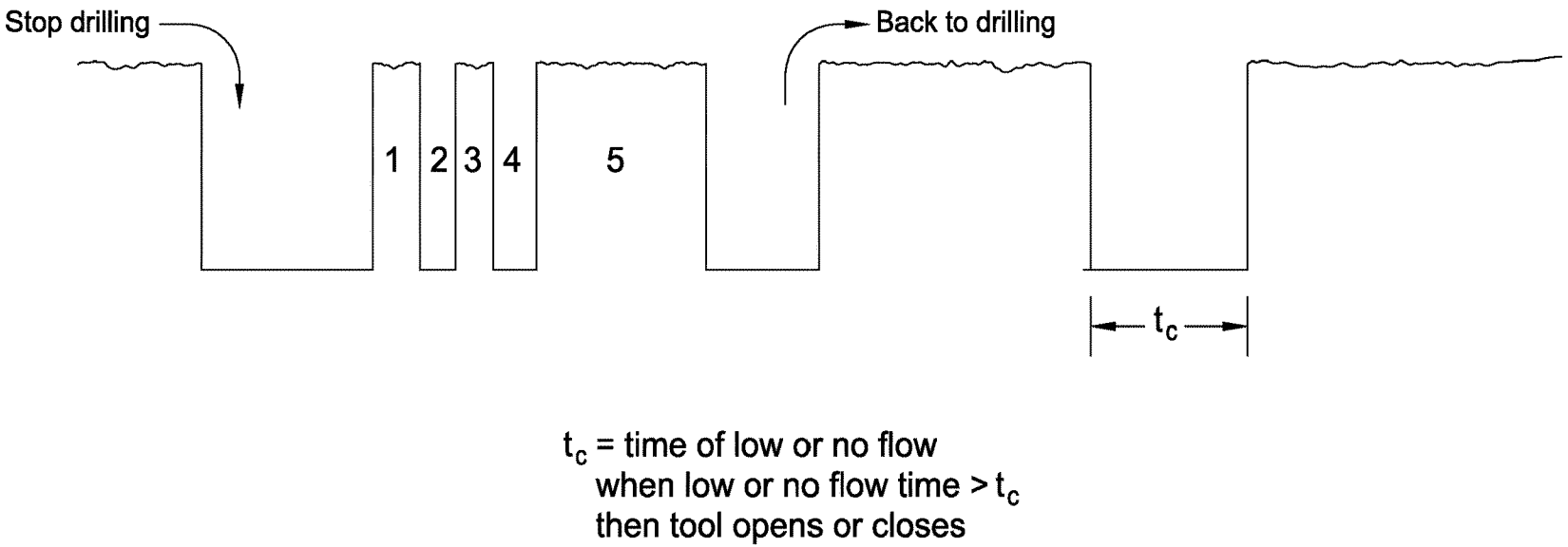
FIG. 9 illustrates another exemplary instruction signal.

In yet another embodiment, the command portion of the signal may instruct the controller to perform a particular function is certain conditions are observed. In the example shown in FIG. 9, the command portion of the signal carries the instruction to close the valve if the flow rate is at or below the lower threshold for than a predetermined period of time. In one example, the command portion may instruct the controller to close the solenoid valve if low or no drilling fluid flow is observed for 15 minutes or any suitable time period, such as between 2 minutes to 30 minutes. In another embodiment, the command portion may cause the controller to open the solenoid valve if this condition is observed.

Figure 11:
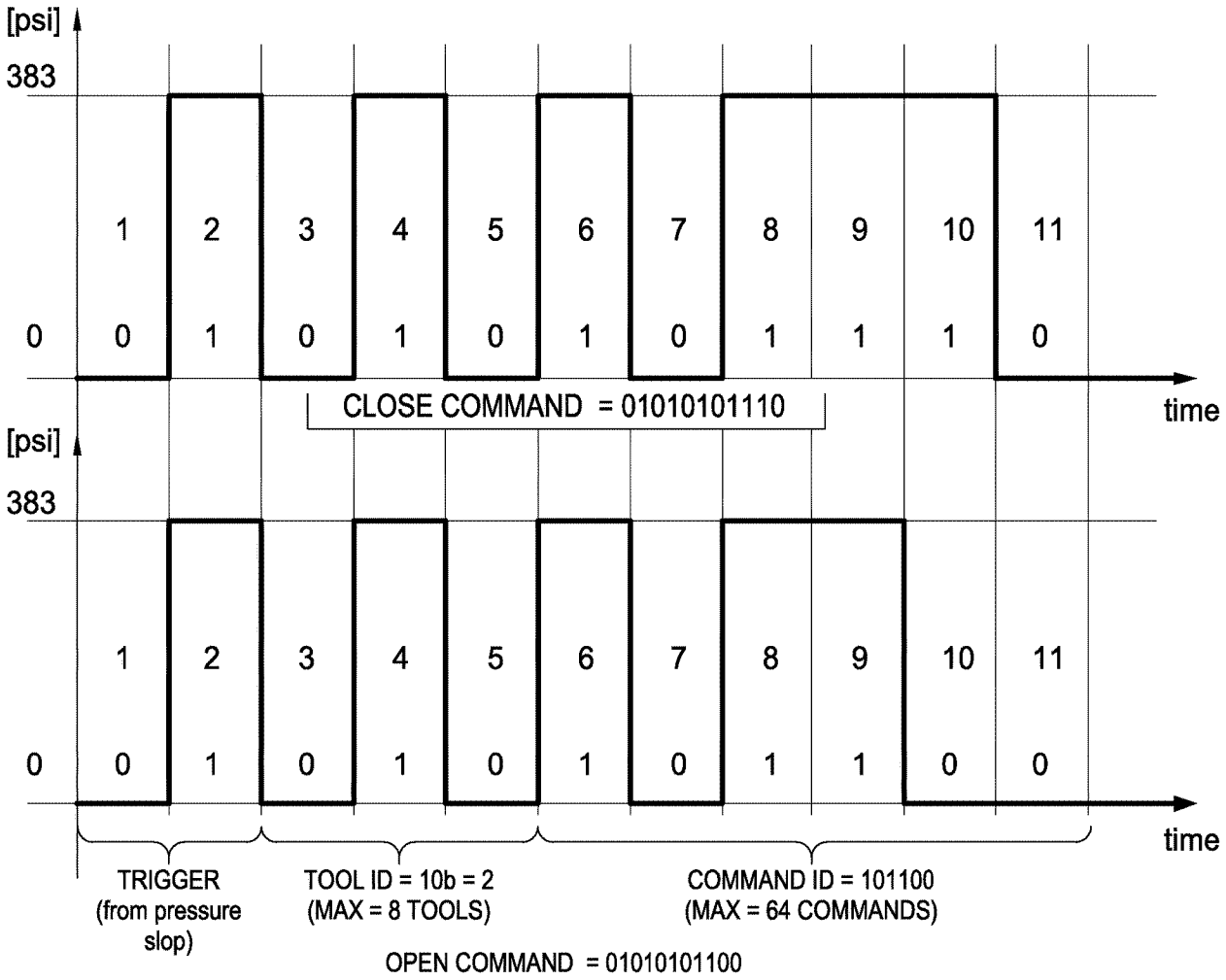
FIG. 11 illustrates an exemplary "open" command digital instruction signal and an exemplary "closed" command digital instruction signal.

FIG. 11 illustrates an exemplary flow rate digital signal for communicating with the control module. FIG. 11 includes an exemplary "open" digital command and an exemplary "close" digital command. As shown, each digital signal includes 11 bits, including 2 bits to represent a trigger portion and 9 bits to represent the command portion, in which 3 bits are used to identify the tool, and 6 bits are used to instruct the tool. Each of the bits may be modulated between a lower pressure such as 0 psi and an upper pressure such as 383 psi. Comparing the two commands, it can be seen that the trigger portion and the tool identification portion are the same, and the only difference is in the instruction portion. The open command is represented by "101100" and the close command is represented by "01110". Although 11 bits are shown, the digital command can have any suitable number of bits, such as between 5 bits and 20 bits, between 7 bits and 15 bits, more than 5 bits, or more than 10 bits. Additionally, the number of bits used to represent each portion of the signal may be altered as necessary. For example, more than 2 bits may be used to identify the trigger, or 2 bits may be used to identify the tool if less than 4 tools are used. In addition, some of the bits in the signal can be blank bits that may be ignored by the control module. For example, if the command can be carried out in 6 bits, than the remaining 3 bits in the command portion are blank bits that can be ignored. In this respect, the flow rate signals may be sent from surface to operate a plurality of tools, such as one or more underreamers, circulation sub, section mills, drilling disconnects, and combinations thereof.

Figure 12:
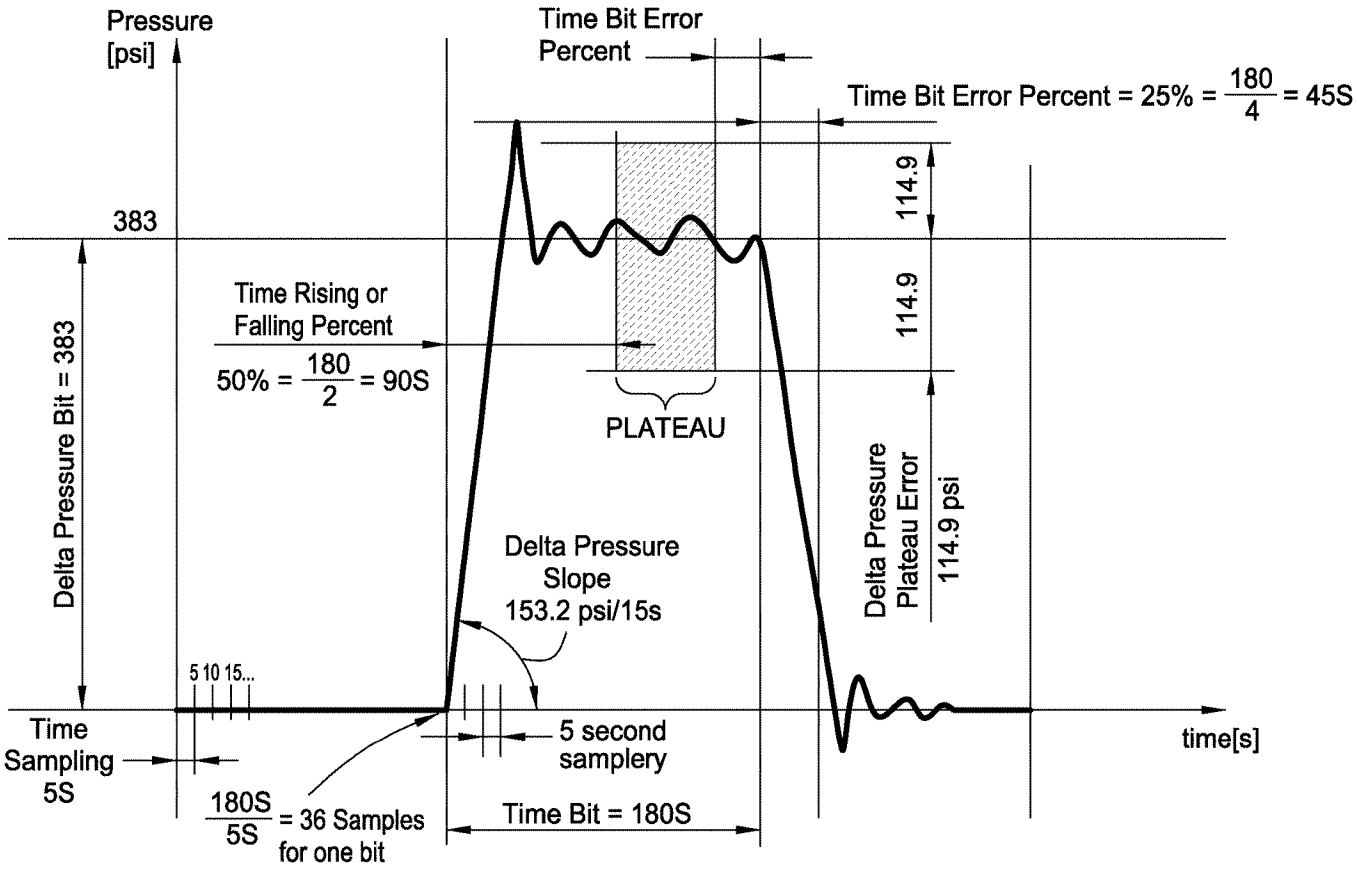
FIG. 12 illustrates three exemplary bits of the digital instruction signal of FIG. 11.

FIG. 12 is a detailed view of three exemplary bits of the open command of FIG. 11. In this example, the first 3 bits are shown. Each bit has a bit time that lasts for 3 minutes, although the bit time of each bit may be between 1 minute and 10 minutes, preferably between 3 minutes and 5 minutes. During each bit, the pressure may be sampled at predetermined intervals, such as 3 seconds, 5 seconds, 10 seconds, and any other suitable interval. The pressure delta of each bit may be between 100 psi and 1,000 psi; preferably between 300 psi and 600 psi; and more preferably, between 350 psi and 500 psi. In this example, the pressure delta of each bit is 383 psi. In one embodiment, the pressure plateau may still be accepted if it is within an acceptable error, such as within 40% above or below the pressure plateau, within 30% above or below the pressure plateau, within 25% above or below the pressure plateau, or within 20% above or below the pressure plateau. In this embodiment, the pressure delta is acceptable if it is within 30% above or below 383 psi, i.e., the pressure plateau. A time delay is allowed for the pressure to reach the pressure plateau. In one embodiment, the time delay is between 15% and 75% of the bit time interval; preferably between 25% and 70%; more preferably, between 40% and 60%. In this example, the time delay is 50% of the bit time, i.e., 90 seconds. During the time delay, the pressure measured will be ignored. The pressure measured after the time delay will be compared to the predetermined acceptable value of the pressure plateau. In this example, the pressure measured after the time delay will be acceptable if it is within 30% above or below 383 psi. The trigger portion may be identified by monitoring for a predetermined rate of change of pressure (also referred to as "delta pressure slope"). In this example, the delta pressure slope is about 153.2 psi/15 sec. Other suitable delta pressure slope may be between 5 psi/sec and 25 psi/sec; preferably, between 8 psi/sec and 15 psi/sec. When the predetermined delta pressure slope is observed during the trigger portion of the digital signal, then the pressure reading algorithm in the control module will be triggered. It must be noted that although the parameters of the digital signal are discussed with respect to flow rate, these parameters are equally applicable to characterize speed modulation, such as the speed of an impeller. For example, instead of a pressure plateau or a pressure delta, the digital signal may be represented by a speed plateau or a speed delta.

Referring to FIG. 11, to open the downhole tool such as an underreamer, the fluid flow rate is reduced to a first flow rate, which in this example, is observed as zero pressure, as represented by area "1". To start the trigger portion, the flow rate is increased to a second flow rate and held for a specific time period (t2), as represented by area "2". During the pressure increase, the control module monitors the delta pressure slope and compares it to the predetermined delta pressure slope. If the delta pressure slope is within the predetermined pressure delta slope, the pressure reading algorithm will be triggered. After the time delay, the control module will compare the measured pressure to the predetermined pressure plateau. The measured pressure plateau is accepted if it is within the acceptable error range of the predetermined pressure plateau. Then, the flow rate is reduced to the first flow rate and held for the same period of time (t3), as represented by area "3". Area 3 also marks the beginning tool identification bits. In this example, three bits are used to identify the tool. Bit 6 to bit 11 are used to instruct the control module. The command portion instructs the control module to keep the solenoid valve for a particular time period, depending on the instruction. The valve open time period may be included in the command portion. Exemplary time periods of keeping the solenoid valve open may be any suitable time period from 15 minutes to 2 hours, such as 30 minutes or 1 hour. After the command portion, the flow rate is reduced for a period of time, and drilling may commence again.

Figure 10:
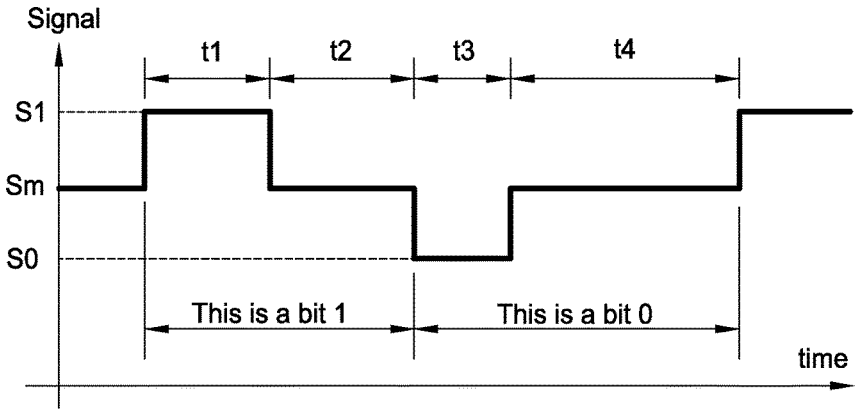
FIG. 10 illustrates an exemplary instruction signal that is not time based.

FIG. 10 illustrates an exemplary instruction signal that is not time based. In this example, to transmit a bit 1, the amplitude of the signal, which may be flow rate or rotational speed, is changed from S1 to Sm. To transmit a bit 0, the amplitude of the signal is changed from Sm to S0. Thus, bit 1 and bit 0 may be represented by only varying the amplitude. As a result, the time (t1, t2, t3, t4) at which the signal is maintained at these values (S1, Sm, S0) is not critical. In this respect, the time values (t1, t2, t3, t4) do not need to be equal, thereby eliminating possible errors due to the operator or system dynamic behavior.

Alternatively, any of the control modules 200, 300, 600, may be used with any of the underreamer 100. Alternatively, any of the sensors or electronics of the telemetry sub 400 may be incorporated into any of the control modules 300, 600 and the telemetry sub 400 may be omitted. Moreover, the control modules 200, 300, 600 may be used to operate other suitable downhole tools, including circulation subs, drilling disconnect, section mills, and combinations thereof. Communication with the control modules to operate any of these downhole tools may include RFID, flow rate commands monitored via pressure changes, flow rate commands monitored via speed changes in the impeller or turbine blades, and combinations thereof.

In another alternative (not shown), any of the electric control modules 300, 600 may include an override connection in the event that the telemetry sub 400 and/or controllers of the control modules fail. An actuator may then be deployed from the surface to the control module through the drill string using wireline or slickline. The actuator may include a mating coupling. The actuator may further include a battery and controller if deployed using slickline. The override connection may be a contact or hard-wire connection, such as a wet-connection, or a wireless connection, such as an inductive coupling. The override connection may be in direct communication with the control module actuator, e.g., the solenoid valve, so that transfer of electricity via the override connection will operate the control module actuator.

In another alternative (not shown), any of the electric control modules 300, 600 may be deployed without the electronics package and without the telemetry sub and include the override connection, discussed above. The wireline or slickline actuator may then be deployed each time it is desired to operate the control module.

Additionally, the telemetry sub 400 or any of the sensors or electronics thereof may be used with the motor actuator, the jar actuator, the vibrating jar actuator, the overshot actuator, or the disconnect actuator disclosed and illustrated in the '077 application.

In one embodiment, a method of drilling a wellbore includes running a drilling assembly into the wellbore through a casing string, the drilling assembly having a tubular string, an underreamer, and a drill bit; injecting drilling fluid through the tubular string and rotating the drill bit, wherein the underreamer remains locked in the retracted position; sending an instruction signal to the underreamer via at least one of modulation of rotational speed of the drilling assembly, modulation of a drilling fluid flow rate, and modulation of a drilling fluid pressure, thereby extending the underreamer; and reaming the wellbore using the extended underreamer.

While the foregoing is directed to embodiments of the present invention, other and further embodiments of the invention may be devised without departing from the basic scope thereof, and the scope thereof is determined by the claims that follow.

The invention claimed is:

1. A method of drilling a wellbore, comprising:

running a drilling assembly into the wellbore through a casing string, the drilling assembly comprising a tubular string, upper and lower underreamers, and a drill bit;

injecting drilling fluid through the tubular string and rotating the drill bit, wherein at least one of the underreamers remain locked in the retracted position;

sending a first instruction signal to the underreamers to extend one of the underreamers;

drilling and reaming the wellbore using the drill bit and the extended underreamer;

sending a trigger portion and a command portion of a second instruction signal to the underreamers via modulation of a rotational speed of the drilling assembly or modulation of a drilling fluid flow rate, thereby extending the other of the underreamers, wherein sending the second instruction signal includes:

sending the trigger portion to a control module to monitor for the command portion; and sending the command portion to instruct the other of the underreamers to extend; and reaming the wellbore using the extended other underreamer.

2. The method of claim 1, wherein the upper underreamer is extended first.

3. The method of claim 1, wherein the first instruction signal is sent via a RFID tag.

4. The method of claim 1, wherein sending the command portion via modulation occurs after sending the trigger portion.

5. A method of drilling a wellbore, comprising:

running a drilling assembly into the wellbore through a casing string, the drilling assembly having a tubular string, a MWD tool or LWD tool, an underreamer, and a drill bit;

injecting drilling fluid through the tubular string and rotating the drill bit, wherein the underreamer remains locked in a retracted position;

sending an instruction signal having a trigger portion and a command portion to the underreamer, wherein sending the instruction signal includes:

sending the trigger portion to trigger a control module of the underreamer to monitor for the command portion, and sending the command portion to instruct the control module to extend the underreamer; and reaming the wellbore using the extended underreamer.

6. The method of claim 5, wherein the instruction signal is sent via modulation of a rotational speed of the drilling assembly or modulation of a drilling fluid flow rate.

7. The method of claim 6, wherein modulation of the rotational speed or fluid flow rate is time based.

8. The method of claim 6, wherein modulation of the rotational speed or fluid flow rate is not time based.

9. The method of claim 5, wherein the trigger portion is identified by measuring a rate of change of pressure over time and comparing the rate of change to a predetermined rate of change of pressure over time value.

10. The method of claim 9, wherein the command portion includes one or more bits for specifying a target tool.

11. A method of drilling a wellbore, comprising:

running a drilling assembly into the wellbore through a casing string, the drilling assembly having a tubular string, a drill bit, and a remotely operable, two-position downhole tool;

sending a first instruction signal to the downhole tool, thereby causing the tool to move from a first position to a second position;

performing a downhole operation using the downhole tool in the second position;

sending a second instruction signal to the downhole tool, thereby causing the downhole tool to return to the first position; and wherein at least one of the first and second instruction signals includes:

a trigger portion for triggering a control module of the downhole tool to monitor for a command portion, and the command portion for instructing the downhole tool to move to the second position in response to the first instruction signal or return to the first position in response to the second instruction signal.

12. The method of claim 11, wherein at least one of the trigger portion and the command portion is produced by modulating a fluid flow rate pattern of a drilling fluid, or modulating an angular speed of the tubular string, or by pressure pulses in the drilling fluid.

13. The method of claim 12, wherein the flow rate pattern includes flowing the fluid at or above a first flow rate and then at or below a second, lower flow rate for the same period of time for at least two cycles.

14. The method of claim 11, wherein the downhole tool is an underreamer.

15. A method of drilling a wellbore, comprising:

running a drilling assembly into the wellbore through a casing string, the drilling assembly having a tubular string, a first underreamer, a second underreamer, and a drill bit;

injecting a drilling fluid through the tubular string and rotating the drill bit, wherein at least one of the first and second underreamers remain in a retracted position; and sending a first instruction signal to the first underreamer and a second instruction signal to the second underreamer, wherein at least one of the first and second instruction signals includes:

a trigger portion for triggering a control module of the first or second underreamers to monitor for a command portion, and the command portion instructs the first or second underreamers to move to the second position in response to the first instruction signal or return to the first position in response to the second instruction signal.

16. The method of claim 15, wherein at least one of the trigger portion and the command portion is produced by modulating a fluid flow rate pattern of the drilling fluid, or modulating an angular speed of the tubular string, or by pressure pulses in the drilling fluid.

17. The method of claim 15, wherein the first underreamer is located above the second underreamer, the first instruction signal to the first underreamer is sent using an RFID tag, and the second instruction signal includes the trigger portion and the command portion.

18. The method of claim 17, wherein the second underreamer is located below a MWD tool or LWD tool.

19. The method of claim 18, wherein the RFID tag flows past the MWD tool or LWD tool and is received by the second underreamer.

* * * * *